US010466016B2

(12) United States Patent
White

(10) Patent No.: US 10,466,016 B2
(45) Date of Patent: Nov. 5, 2019

(54) BALLISTIC SHIELD

(71) Applicant: Defenshield, Inc., St. Augustine, FL (US)

(72) Inventor: William Collins White, St. Augustine, FL (US)

(73) Assignee: Defenshield, Inc., St. Augustine, FL (US)

( * ) Notice: Subject to any disclaimer, the term of this patent is extended or adjusted under 35 U.S.C. 154(b) by 0 days.

(21) Appl. No.: 15/973,450

(22) Filed: May 7, 2018

(65) Prior Publication Data

US 2019/0033040 A1 Jan. 31, 2019

Related U.S. Application Data

(60) Provisional application No. 62/513,735, filed on Jun. 1, 2017.

(51) Int. Cl.

| | |
|---|---|
| ***F41H 5/013*** | (2006.01) |
| ***F41H 5/06*** | (2006.01) |
| ***F41H 5/14*** | (2006.01) |

(52) U.S. Cl.

CPC ..... *F41H 5/013* (2013.01); *F41H 5/06* (2013.01); *F41H 5/14* (2013.01)

(58) Field of Classification Search

CPC ..... F41H 5/013; F41H 5/06; F41H 5/14
USPC ..... 89/36.02
See application file for complete search history.

(56) References Cited

U.S. PATENT DOCUMENTS

| | | | | | |
|---|---|---|---|---|---|
| 772,055 | A | | 10/1904 | Post | |
| 1,253,964 | A | | 1/1918 | Hack | |
| 1,261,518 | A | | 4/1918 | Hahre | |
| 1,274,721 | A | | 8/1918 | Krzan | |
| 1,281,400 | A | * | 10/1918 | Larnell | F41H 5/14 109/49.5 |
| 1,327,464 | A | | 1/1920 | Dewick et al. | |
| 1,465,042 | A | | 8/1923 | Hruska | |
| 1,875,488 | A | | 9/1932 | Peters | |
| 2,209,654 | A | * | 7/1940 | Loeser, Jr. | F41H 5/08 109/49.5 |
| 2,370,596 | A | * | 2/1945 | Wallace | F41H 5/08 109/49.5 |
| 2,613,243 | A | | 10/1952 | Frear | |
| 2,845,153 | A | | 7/1958 | West | |
| 2,878,054 | A | | 3/1959 | Linder | |
| 2,937,602 | A | | 5/1960 | Norries | |

(Continued)

FOREIGN PATENT DOCUMENTS

| | | |
|---|---|---|
| DE | 64291 C | 2/1892 |
| DE | 2412568 | 9/1975 |

(Continued)

*Primary Examiner* — Michelle Clement
(74) *Attorney, Agent, or Firm* — Condo Roccia Koptiw LLP

(57) ABSTRACT

A ballistic shield that is movable between an extended position and a retracted position is disclosed. In the extended position, the shield extends from the supporting surface to at least a height of a lower edge of a front wall of a ballistic barrier. In the extended position, the shield provides protection in an area corresponding to a gap between the front wall and the supporting surface. In the retracted position, the shield is removed relative to the supporting surface and provides clearance from the supporting surface.

18 Claims, 44 Drawing Sheets

114

(56) References Cited

U.S. PATENT DOCUMENTS 2,985,174 A 5/1961 Guth
3,039,161 A 6/1962 Gagnon
3,590,685 A 7/1971 Lane
3,712,005 A 1/1973 Eschbach et al.
3,942,598 A 3/1976 Council
3,994,243 A 11/1976 Anders
4,016,666 A * 4/1977 Finn ..... F41A 17/56 42/1.01
4,030,219 A 6/1977 Donovan
4,061,093 A 12/1977 Carstens, Jr. et al.
4,245,546 A * 1/1981 Chaires ..... F41H 5/14 109/49.5
4,351,558 A 9/1982 Mueller
4,416,485 A 11/1983 Long
4,674,394 A 6/1987 Martino
4,781,101 A * 11/1988 Zevuluni ..... F41H 5/14 109/49.5
4,901,964 A 2/1990 McConnell
4,949,490 A 8/1990 Miller
4,953,820 A 9/1990 Yoder
5,244,172 A 9/1993 Allega
5,293,807 A 3/1994 Hajdu
5,368,904 A 11/1994 Stephinson
5,419,479 A 5/1995 Evels et al.
5,438,908 A 8/1995 Madden, Jr.
5,560,149 A 10/1996 Lafevre
5,641,934 A 6/1997 Follett
5,666,773 A 9/1997 Librande et al.
5,703,316 A 12/1997 Madden, Jr.
5,829,653 A 11/1998 Kaiser
5,857,730 A 1/1999 Korpi et al.
5,878,519 A 3/1999 Huyck et al.
5,953,820 A 9/1999 Vasudeva
6,000,347 A * 12/1999 Madden, Jr. ..... A45C 9/00 109/22
6,116,326 A 9/2000 Domina et al.
6,170,379 B1 1/2001 Taylor
6,272,781 B1 * 8/2001 Resnick ..... F41H 1/00 2/2.5
6,279,449 B1 * 8/2001 Ladika ..... F41H 5/007 89/36.02
6,333,085 B1 12/2001 Emek
6,622,607 B1 * 9/2003 Miller ..... F41H 5/06 2/2.5
6,845,701 B2 * 1/2005 Drackett ..... F41H 5/14 89/36.09
6,907,811 B2 * 6/2005 White ..... F41H 5/06 109/49.5
6,962,461 B2 11/2005 Choi et al.
7,069,680 B1 7/2006 Crawford
7,102,814 B1 * 9/2006 Hughes ..... F41H 3/00 250/504 R
7,104,720 B2 9/2006 Humphries et al.
7,128,308 B2 10/2006 Marsh et al.
7,302,880 B1 * 12/2007 Elasic ..... F41H 5/08 89/36.01
7,520,207 B1 * 4/2009 Fuqua ..... F41H 5/013 109/82
7,584,689 B2 * 9/2009 Jones ..... B32B 17/10009 89/36.02
7,594,515 B2 * 9/2009 Prock ..... F41H 3/00 135/115
7,849,781 B2 12/2010 White
7,891,283 B2 2/2011 Kleniatis et al.
8,015,910 B1 * 9/2011 Fuqua ..... F41H 5/14 89/36.01
8,272,309 B1 * 9/2012 Cumberland ..... F41H 5/0414 89/36.02
8,327,748 B2 * 12/2012 Conroy ..... F41H 5/06 89/36.02
8,726,782 B2 5/2014 White
9,347,748 B1 * 5/2016 Crisp ..... F41H 5/08
9,448,041 B2 * 9/2016 Gonda ..... F41H 5/14
9,616,261 B1 * 4/2017 Rambert ..... E04B 1/94
9,885,539 B2 * 2/2018 Spransy ..... F41C 27/04
2004/0255769 A1 * 12/2004 Drackett ..... F41H 5/14 89/36.09
2005/0217472 A1 * 10/2005 Baker ..... F41H 5/08 89/36.06
2005/0265780 A1 12/2005 Humphries et al.
2006/0230916 A1 * 10/2006 Sand ..... F41H 3/00 89/36.07
2007/0131103 A1 * 6/2007 McClellan ..... F41H 5/12 89/37.03
2007/0193441 A1 * 8/2007 Carter ..... F41H 5/08 89/36.07
2007/0283477 A1 * 12/2007 Dovner ..... F41C 33/0209 2/2.5
2008/0087684 A1 * 4/2008 Koshimoto ..... B65D 83/20 222/192
2010/0083820 A1 * 4/2010 Doyner ..... F41H 5/08 89/36.02
2011/0011255 A1 * 1/2011 Kleniatis ..... F41H 5/08 89/36.09
2011/0226123 A1 * 9/2011 Priebe ..... F41H 5/08 89/36.02
2012/0174768 A1 * 7/2012 Spransy ..... F41H 5/013 89/36.09

FOREIGN PATENT DOCUMENTS

FR 462049 1/1914
FR 2607238 5/1988
WO WO 94/029665 12/1994
WO WO 09/048650 4/2009

* cited by examiner

114

BALLISTIC SHIELD

CROSS-REFERENCE TO RELATED APPLICATIONS

This application claims the benefit of U.S. Provisional Patent Application No. 62/513,735, filed Jun. 1, 2017, the contents of which are hereby incorporated by reference in their entirety.

BACKGROUND

Military, government, and security personnel are often asked to perform duties in areas where they are at risk of injury from ballistics, explosions, and/or harmful projectiles. For example, persons who are responsible for standing guard at an entrance to a building or installation are often at risk of attack. In such settings, there is a need for barriers or fortifications behind which persons can position themselves for protection.

SUMMARY

Applicant discloses a ballistic shield for use with barrier systems. The shield is movable between an extended position and a retracted position relative to a front wall of a barrier to which the shield is attached. In the extended position, the shield extends from the supporting surface to at least a height of a lower edge of the front wall of the barrier. The shield provides protection from projectiles including ballistics and/or spall that might enter a gap between the front wall and the supporting surface. In the retracted position, the shield is retracted relative to the supporting surface and thereby provides clearance to facilitate movement of the barrier.

In an example embodiment, the front wall of the barrier extends in a substantially upward direction relative to a supporting surface and comprises a lower edge and an upper edge. The barrier may further comprise a first side wall that extends at an angle from the front wall and extends upward from the supporting surface. A second side wall may extend at an angle from the front wall and extend upward from the supporting surface. In an example embodiment, the first side wall and the second side wall extend substantially perpendicular to the front wall and substantially parallel to each other.

In an example embodiment, the barrier may be mounted on wheel systems such as casters. Mounting on the wheel systems may result in the bottom edge of the front wall being spaced apart from the supporting surface. In other words, a gap may be formed between the lower edge of the front wall and the supporting surface.

In an example embodiment, the shield is movably attached to the first side wall and the second side wall. The shield is movable relative to the side walls between the extended position and the retracted position. In the extended position, the shield is positioned to abut the supporting surface and extends upward from adjacent the supporting surface to a height at least equal to a height of the gap formed between the lower edge of the front wall and the supporting surface. In the retracted position, the shield is withdrawn relative to the supporting surface.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features are described below.

BRIEF DESCRIPTION OF DRAWINGS

The following description of the illustrative embodiments may be better understood when read in conjunction with the appended drawings. It is understood that potential embodiments of the disclosed systems and methods are not limited to those depicted.

DETAILED DESCRIPTION

Figure 1A:
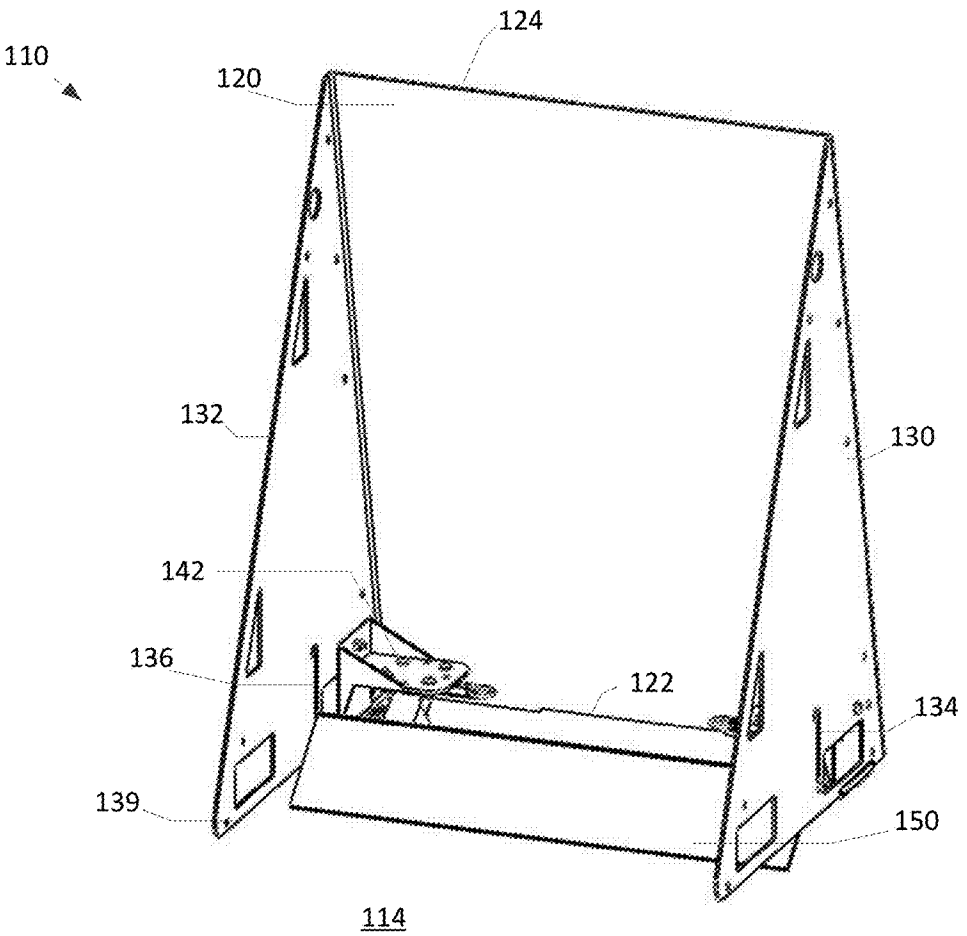
FIG. 1A depicts a rear perspective view of an example barrier with a shield in an extended position.
Figure 1B:
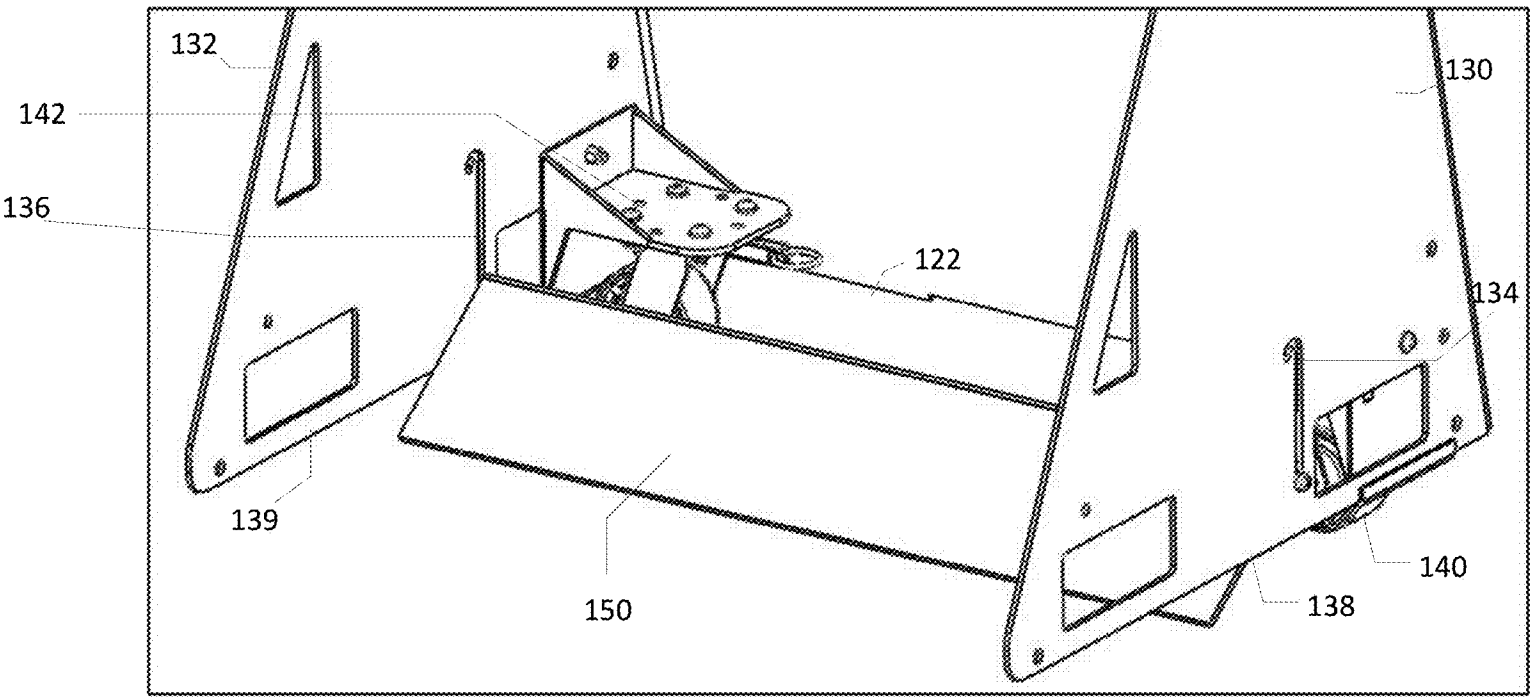
FIG. 1B depicts an isolated rear perspective view of an example barrier with a shield in an extended position.
Figure 1C:
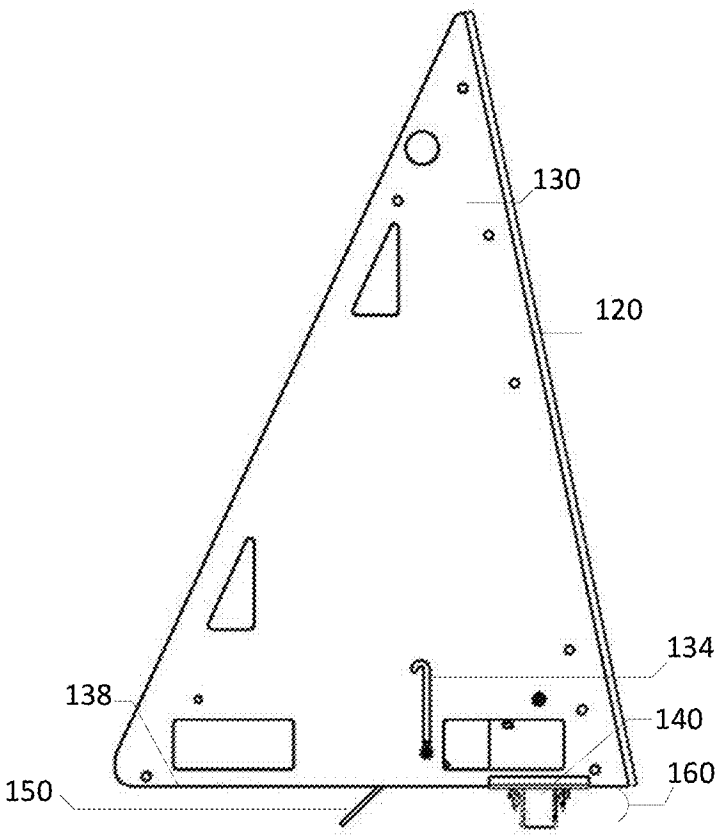
FIG. 1C depicts a side view of an example barrier with a shield in an extended position.
Figure 1D:
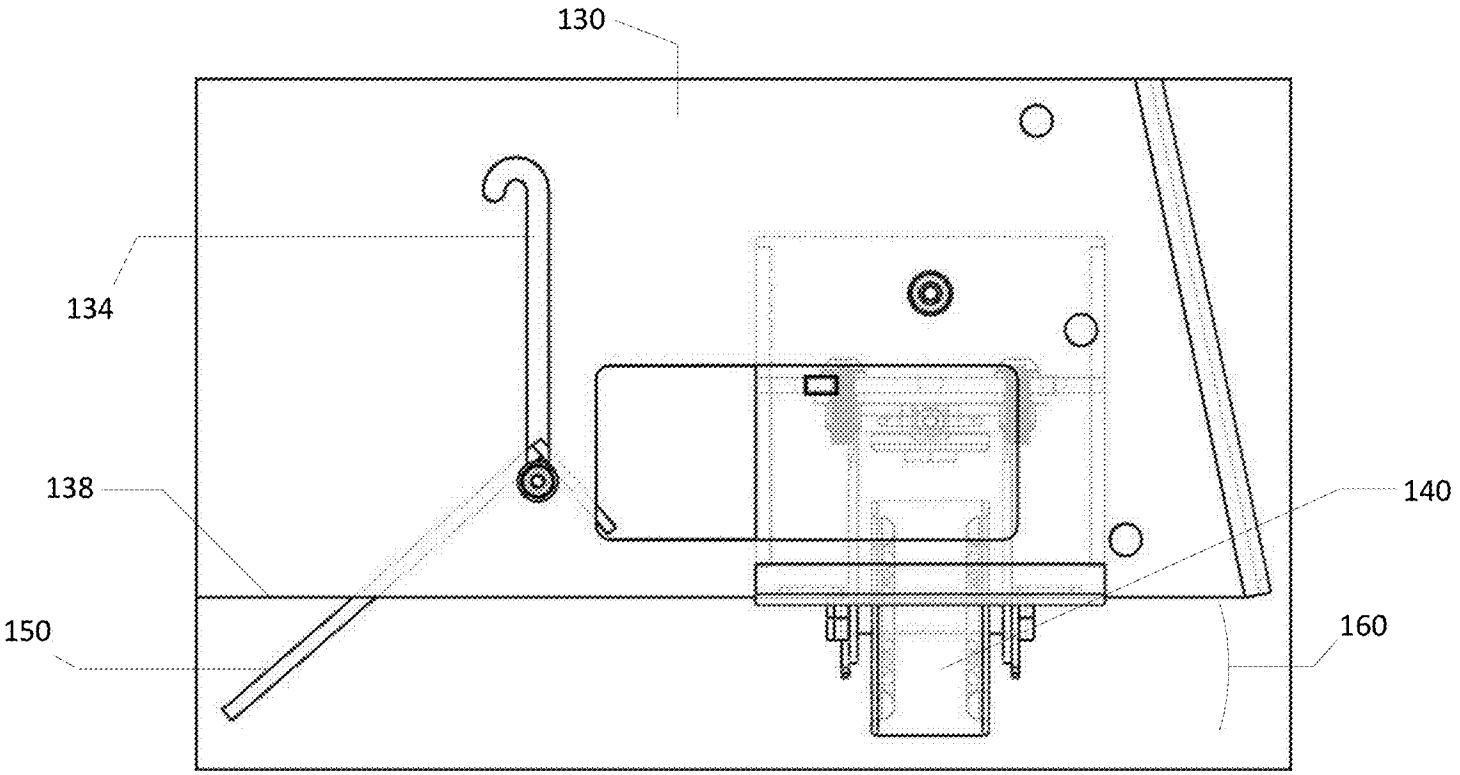
FIG. 1D depicts a side view, partially in transparency, of an example barrier with a shield in an extended position.
Figure 1E:
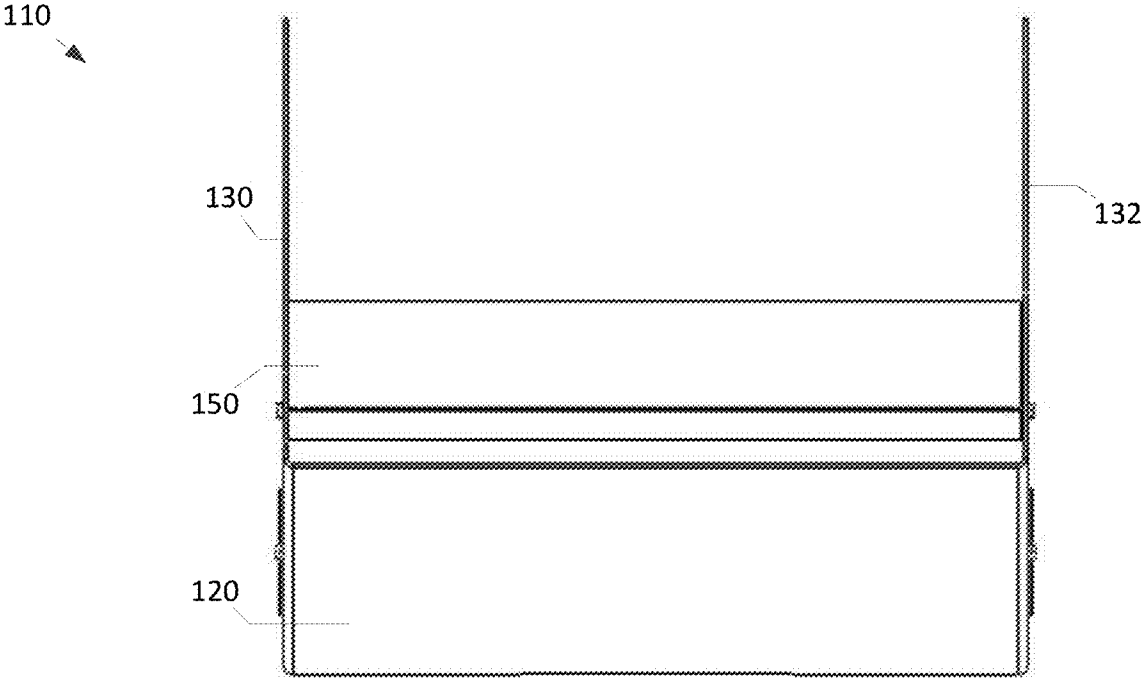
FIG. 1E depicts a top view of an example barrier with a shield in an extended position.
Figure 1F:
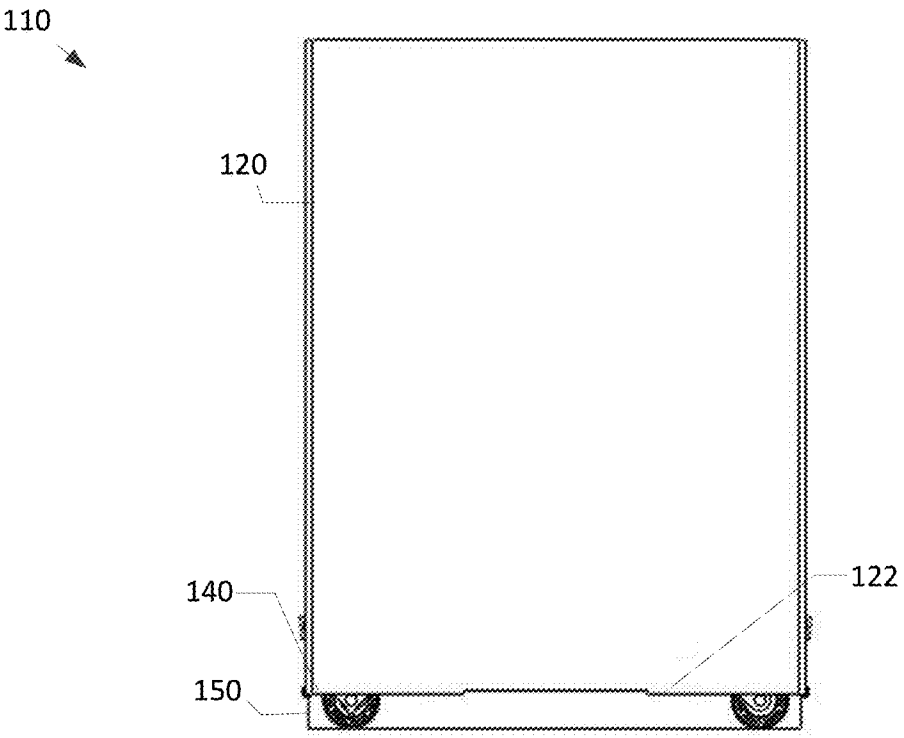
FIG. 1F depicts a front view of an example barrier with a shield in an extended position.
Figure 2A:
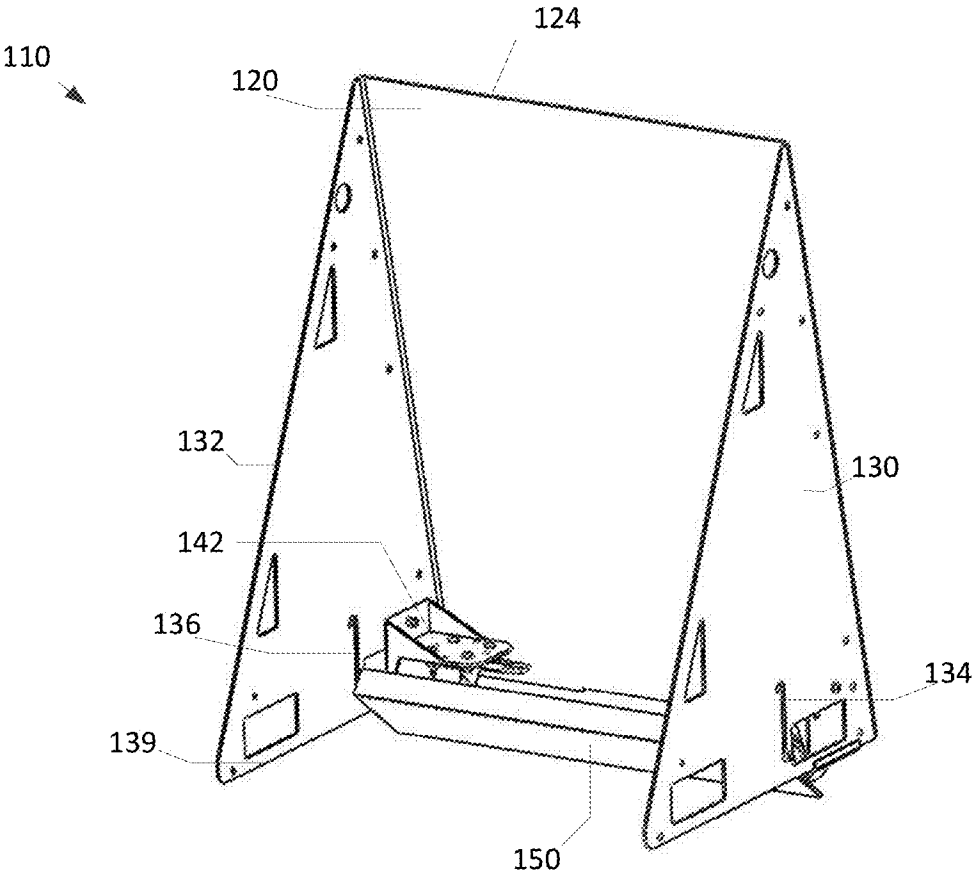
FIG. 2A depicts a rear perspective view of an example barrier with a shield in an extend position.
Figure 2B:
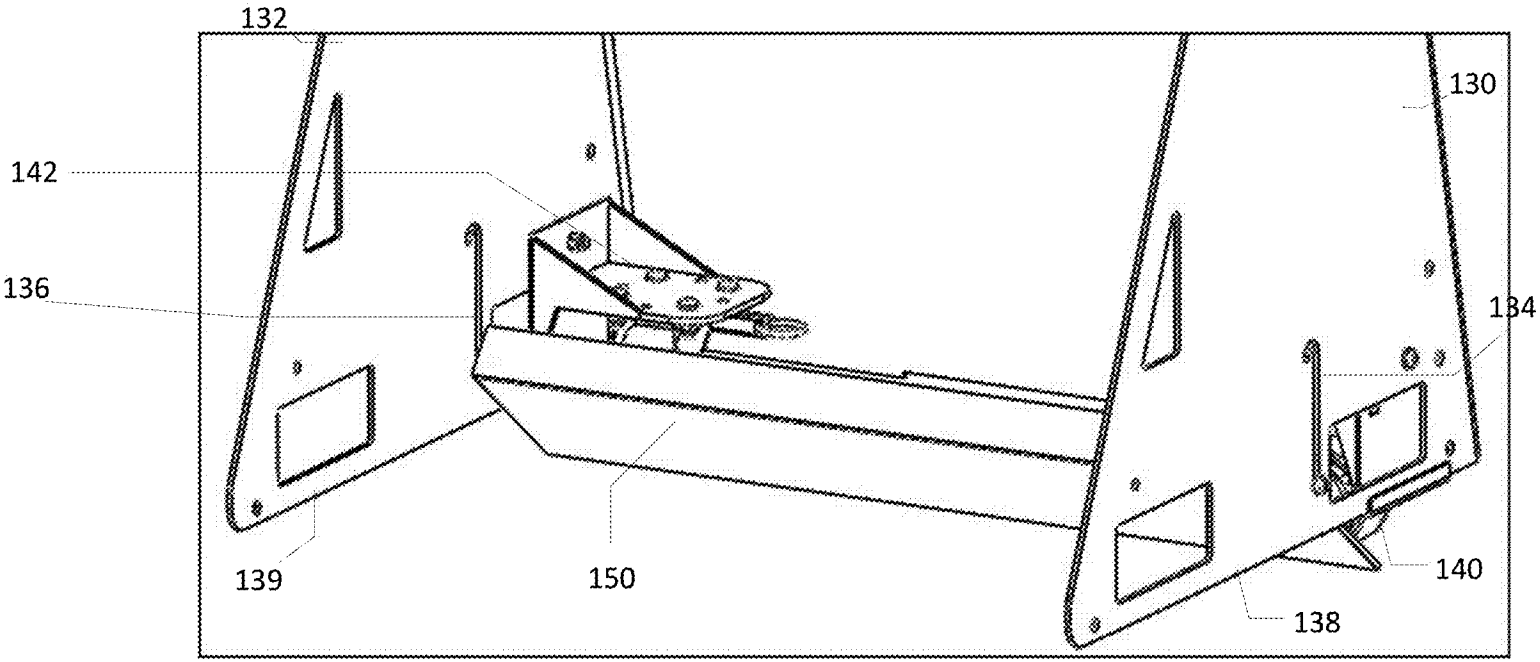
FIG. 2B depicts an isolated rear perspective view of an example barrier with a shield in an extended position.
Figure 2C:
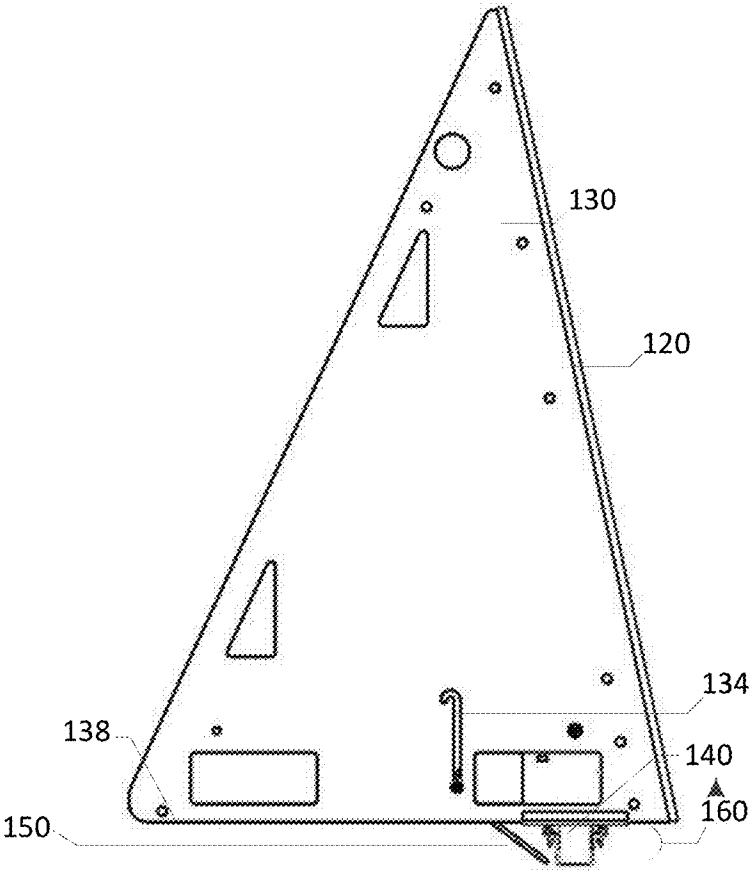
FIG. 2C depicts a side view of an example barrier with a shield in an extended position.
Figure 2D:
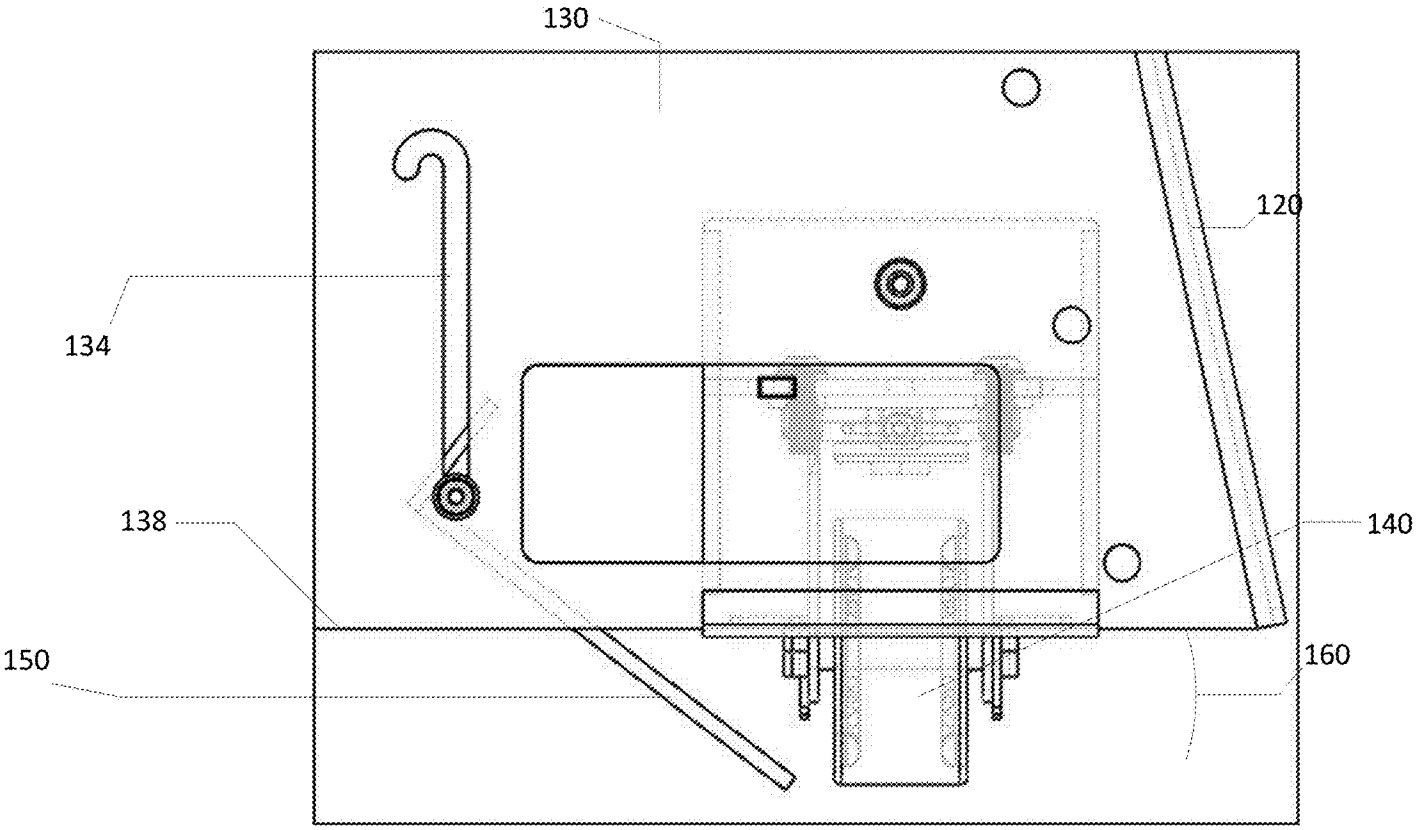
FIG. 2D depicts a side view, partially in transparency, of an example barrier with a shield in an extended position.
Figure 2E:
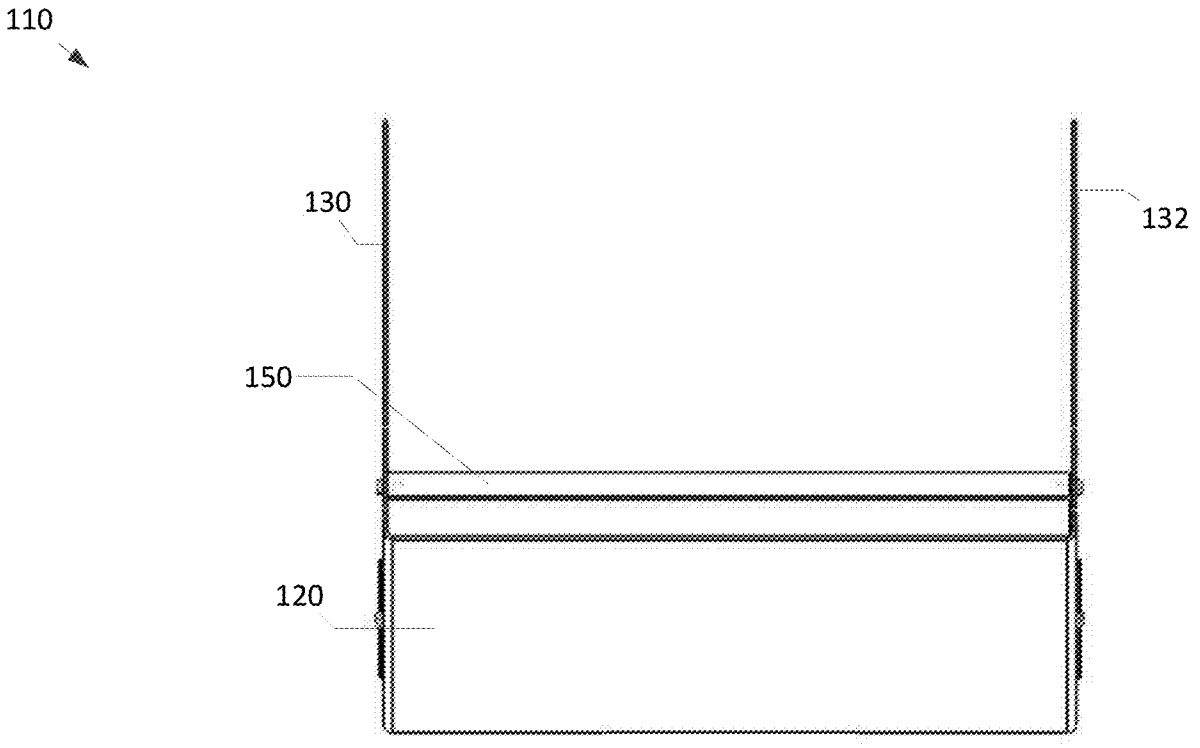
FIG. 2E depicts a top view of an example barrier with a shield in an extended position.
Figure 2F:
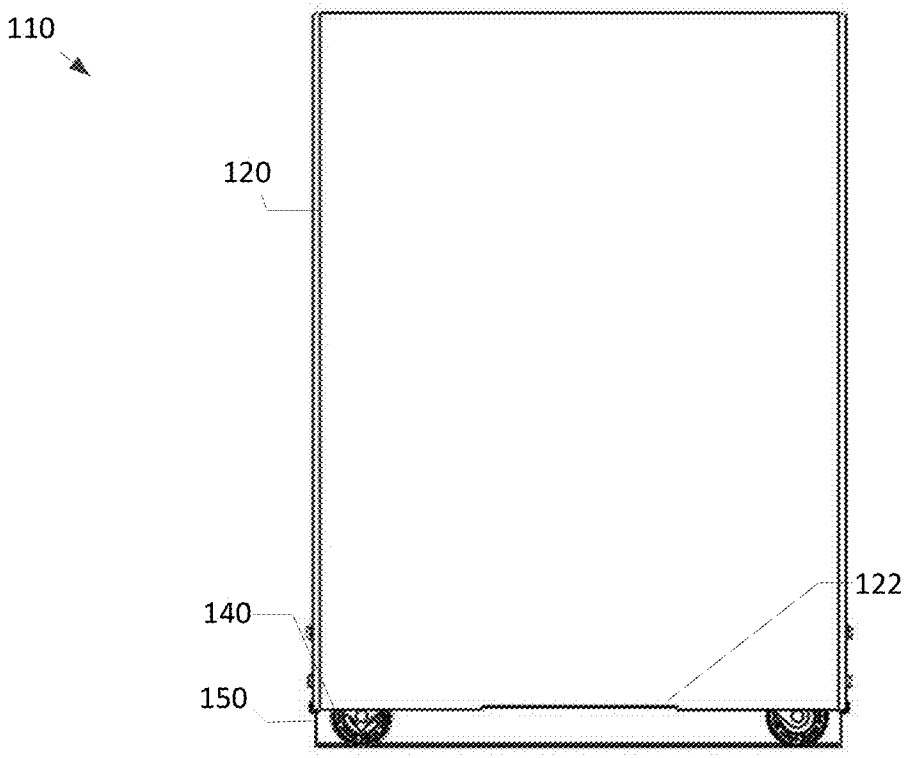
FIG. 2F depicts a front view of an example barrier with a shield in an extended position.

Applicant discloses a shield for use with a barrier that provides protection from projectiles. In an example embodiment, the barrier may comprise a front wall having a lower edge and an upper edge. The front wall extends in a substantially upward direction relative to a supporting surface, with the lower edge spaced apart from the supporting surface. The retractable shield may be moved between an extended position and a retracted position relative to the barrier. In the extended position, the shield extends from the supporting surface to at least a height of a lower edge of a front wall of the shield. In the extended position, the shield provides protection in an area corresponding to any gap between the front wall and the supporting surface. In the retracted position, the shield is removed relative to the supporting surface and provides clearance which might facilitate movement of the barrier.

FIGS. 1A-1F depict an example barrier system with a shield in an extended position. As shown, barrier 110 comprises a front wall 120 having a lower edge 122 and an upper edge 124. The front wall extends in a substantially upward direction relative to the supporting surface 114. Front wall is adapted to prevent projectiles that strike the first side of the front wall from penetrating through to the second side. In an example embodiment, front wall 120 may be an armored panel or wall formed from materials such as metal, masonry, and/or carbon fiber capable of withstanding ballistics and blast projectiles.

Side panels or walls 130 and 132 extend from front wall 124 and operate to stabilize front panel 124 and maintain barrier 110 in an upright position. Side walls 130 and 132 extend upward from supporting surface 114 and are rigidly coupled to front wall 124. In an example embodiment, front wall 124 leans toward side walls 130 and 132 such that at least part of the weight of front wall 124 is supported by side walls 130 and 132. Side walls 130 and 132 extend upward from lower edges 138 and 139, respectively. In an example embodiment, a portion of lower edges 138 and 139 may contact supporting surface 114. Side walls 130 and 132 are adapted to prevent projectiles that strike the walls from penetrating from an exterior first side through to a protected second side. In an example embodiment, side walls 130 and 132 may be an armored panel or wall formed from materials such as metal, masonry, and/or carbon fiber capable of withstanding ballistics and blast projectiles.

In an example embodiment, barrier 110 further comprises wheel systems 140 and 142 which facilitate movement of barrier 110. In an example embodiment, wheel systems 140 and 142 may be casters with wheels that swivel. Wheel systems 140 and 142 may be attached to side walls 130 and 132, respectively, in proximity to the location that side walls 130 and 132 are attached to front wall 124. Wheel systems 140 and 142 extend below lower edges 138 and 139 of side walls 130 and 132 and below lower edge 122 of front wall 124. Wheels that are part of wheel systems 140 and 142 contact supporting surface 114 and support at least a portion of the weight of barrier 110. When wheels of wheel systems 130 and 132 contact supporting surface 114, a gap is formed between the supporting surface and the lower edges 122, 138, and 139.

Barrier 110 further comprises shield 150 which is adapted to be moved between an extended position and a retracted position. In an extended position, as illustrated in FIGS. 1A-F and 2A-F, shield 150 abuts supporting surface 114 and extends upward from adjacent supporting surface 114 to a height at least equal to gap 160 formed between lower edge 122 of front wall 124 and supporting surface 114. In a retracted position, as illustrated in FIGS. 3A-F, shield 150 is withdrawn relative to the supporting surface.

In an example embodiment, and as illustrated in FIGS. 4A-D, shield 150 comprises a first planar portion 152 and a second planar portion 154. Second planar portion 154 intersects with and extends from first planar portion 152 at an angle, which may be, for example, an approximately ninety (90) degree angle. In an example embodiment, first planar portion 152 is longer than second planar portion 154. Shield 150 is adapted to prevent projectiles that strike panels 152 and 154 from penetrating from an exterior first side through to a protected second side. In an example embodiment, shield 150 may be armored and formed from materials such as metal, masonry, and/or carbon fiber capable of withstanding ballistics and blast projectiles.

Shield 150 further comprises a first retention member 156 and a second retention member 158 which extend from opposing sides of shield 150. In an example embodiment, retention members 156 and 158 extend from opposing sides of shield proximate the location the first planar portion 152 and second planar portion 154 intersect. Retention members 156 and 158 are received in corresponding recesses 134 and 136 formed in side walls 130 and 132. Recesses 134 and 136 may be elongated and extend upward from a location proximate bottom edges 138 and 139 of side walls 130 and 132, to a location further removed or remote from bottom edges 138 and 139. When shield 150 is in the extended position abutting supporting surface 114, retention members 156 and 158 are located at or near the portion of recesses 134 and 136 closest to bottom edges 138 and 139. As illustrated in FIGS. 3A-F, when shield 150 is in its retracted position, retention members 156 and 158 are in recesses 134 and 136, but are removed to a location relatively remote from lower edges 138 and 139 of side walls. It will be appreciated that retention members 156 and 158 may travel within recesses 134 and 136 in response to forces applied to shield 150 and/or barrier 110. It will be appreciated that retention members 156 and 158 are pivotally moveable relative to recesses 134 and 136. Accordingly, shield 150 may be pivoted about retention members 156 and 158, which may pivot within recesses 134 and 136.

First planar portion 152 of shield 150 extends between side walls 130 and 132 and slopes downward from a height corresponding to the location of retention members 156 and 158 in recesses 134 and 136 to a position adjacent to supporting surface 114. As illustrated in FIGS. 1A-F, first planar portion 152 may be positioned to slope down and away relative to front wall 120. Second planar portion 154 extends at approximately a ninety-degree angle to first planar portion 152 and extends downward and toward front wall 120. In the position shown in FIGS. 1A-F, barrier 110 may be moved forward while shield 150 is in its extended position. The sloping arrangement of first planar portion 152 accommodates movement of the shield over supporting surface 114 in instances when barrier 110 is moved forward. If barrier 110 is moved backward while shield 150 positioned as in FIGS. 1A-F, the motion of shield 150 may be impeded by friction with supporting surface 114. In such a scenario, shield 150 may remain substantially in a fixed position relative to the remainder of barrier 110. Retention members 156 and 158 slide upward in recesses 134 and 136 as shield 150 remains substantially in a fixed position relative to the remainder of barrier 110 which may move backward. As retention members 156 and 158 slide upward in recesses 134 and 136, first planar portion 152 assumes an increasingly steep angle relative to supporting surface 114. If movement of barrier 110 relative to shield 150 continues, first planar portion 152 may assume a position wherein it slopes toward front wall 120 as illustrated in FIGS. 2A-F.

As shown in FIGS. 2A-F, first planar portion 152 may be positioned to extend from its location in recesses 134 and 136 toward supporting surface 114. First planar portion 152 slopes down and toward front wall 120. In the position shown in FIGS. 2A-F, barrier 110 may be moved backward while shield 150 is in its extended position. The sloping arrangement of first planar portion 152 accommodates movement of shield 150 over supporting surface 114 when barrier 110 is moved backward. However, if shield 150 is positioned to slope toward front wall 120 as shown in FIGS. 2A-F and barrier 110 is moved forward, shield 150 may remain substantially in a fixed position relative to the remainder of barrier 110 due to friction between shield 150 and supporting surface 114. Retention members 156 and 158 slide upward in recesses 134 and 136 as shield 150 remains substantially in a fixed position relative to the remainder of barrier 110. As retention members 156 and 158 slide upward in recesses 134 and 136, first planar portion 152 assumes an increasingly steep angle relative to supporting surface 114. If movement of barrier 110 relative to shield 150 continues, first planar portion 152 may assume a position wherein it slopes away from front wall 120 as illustrated in FIGS. 1A-F. It will be appreciated that shield 150 may move between positions illustrated in FIGS. 1A-F and FIGS. 2A-F as barrier 110 is moved forward and backward. In both positions, shield 150 provides protection from projectiles and spall that may enter upon a gap 160 between lower edge 122 of front wall 120 and supporting surface 114.

Figure 3A:
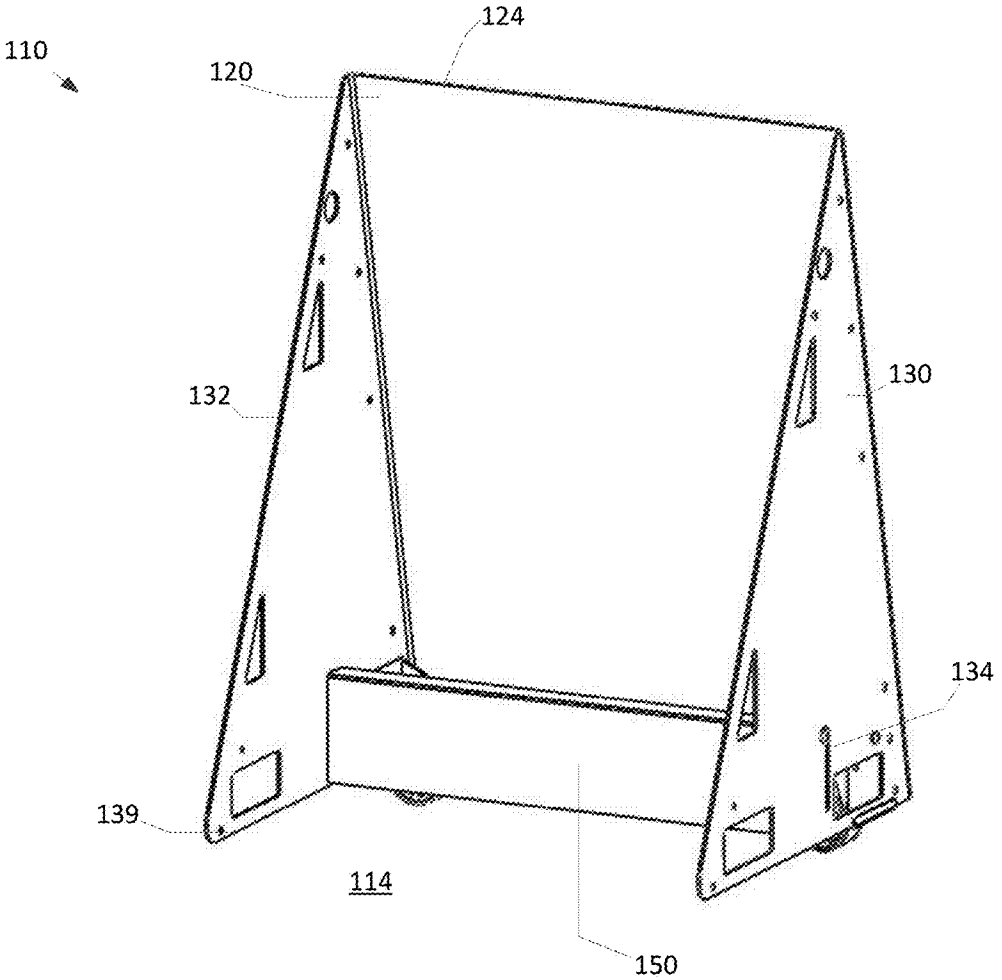
FIG. 3A depicts a rear perspective view of an example barrier with a shield in a retracted position.
Figure 3B:
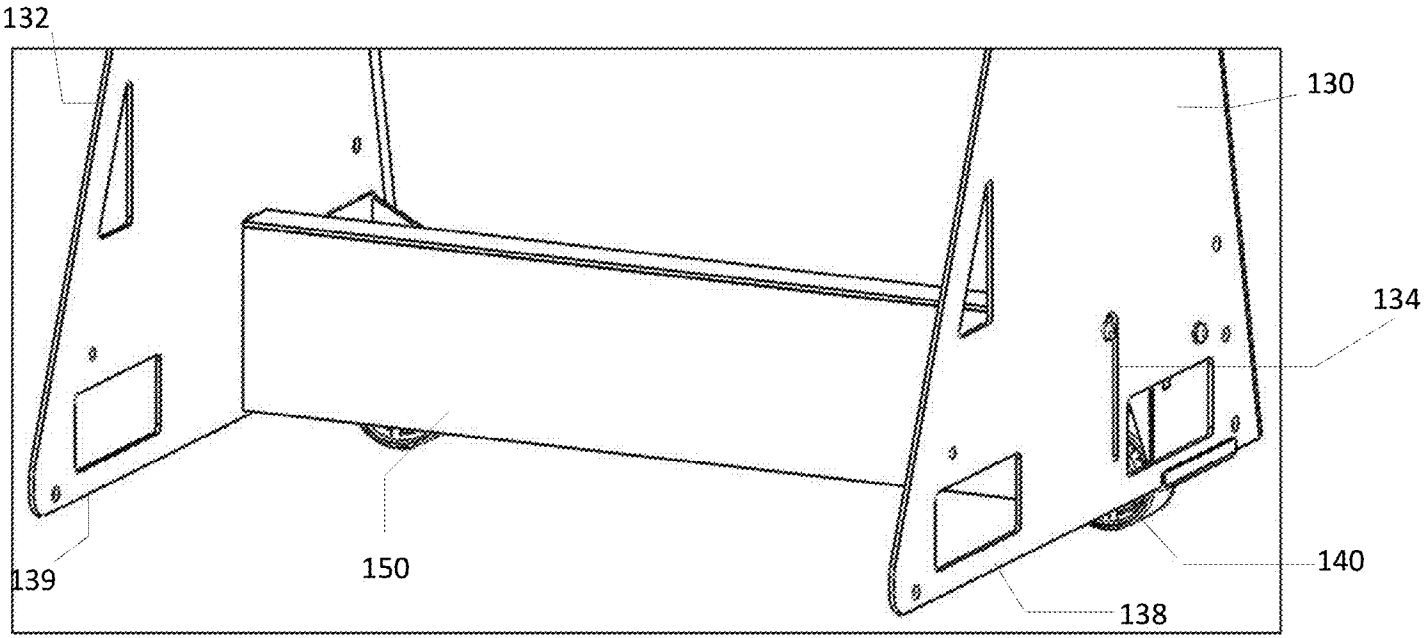
FIG. 3B depicts an isolated rear perspective view of an example barrier with a shield in a retracted position.
Figure 3C:
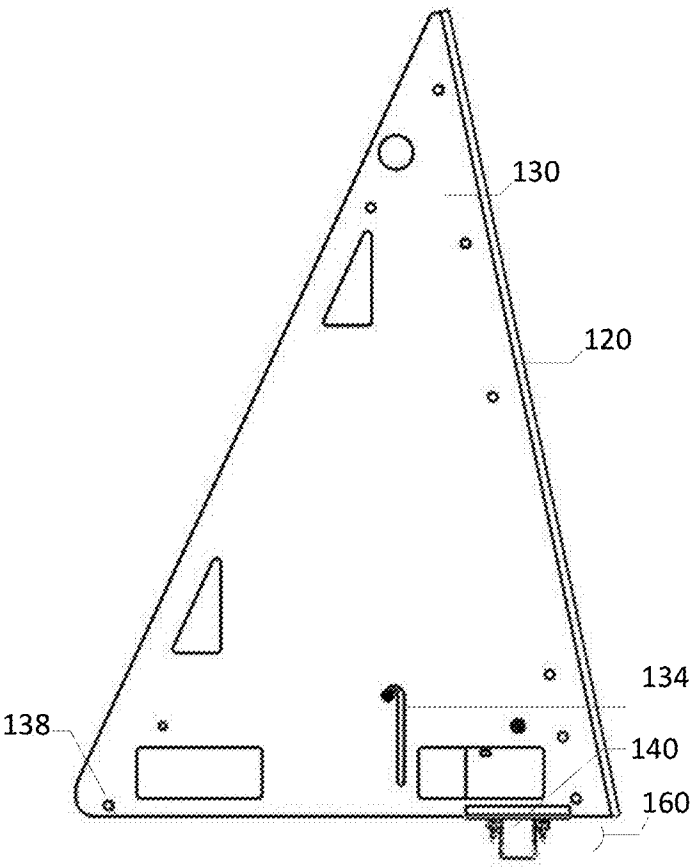
FIG. 3C depicts a side view of an example barrier with a shield in a retracted position.
Figure 3D:
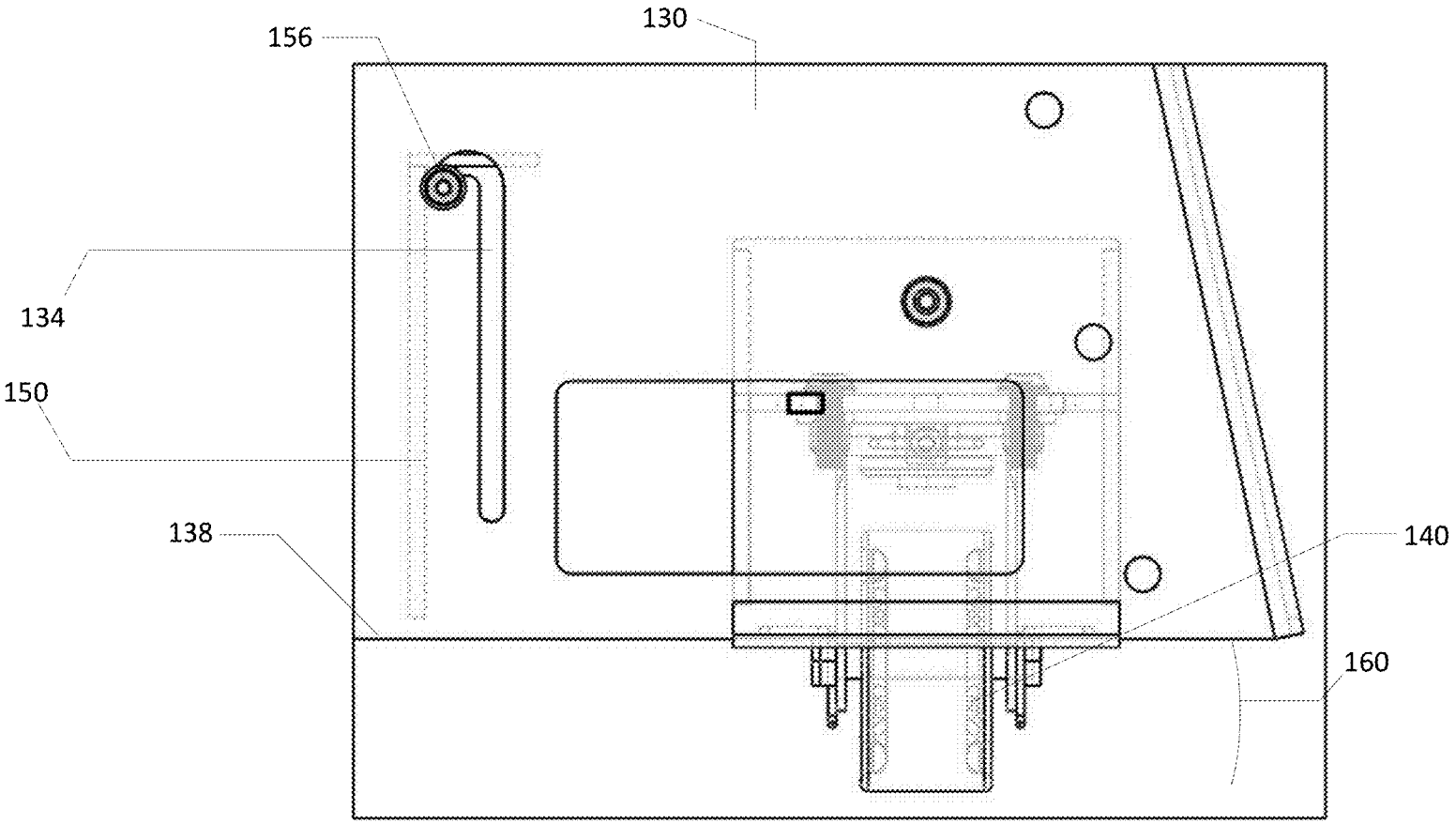
FIG. 3D depicts a side view, partially in transparency, of an example barrier with a shield in a retracted position.
Figure 3E:
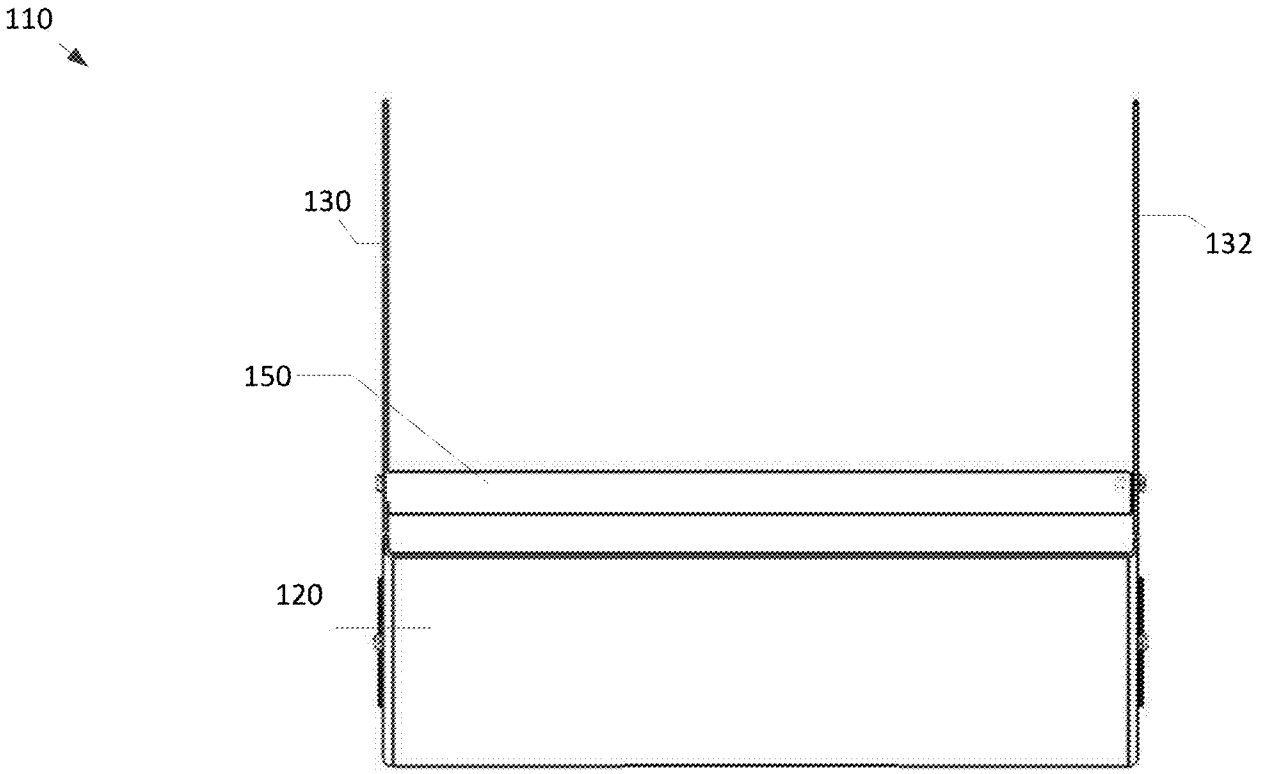
FIG. 3E depicts a top view of an example barrier with a shield in a retracted position.
Figure 3F:
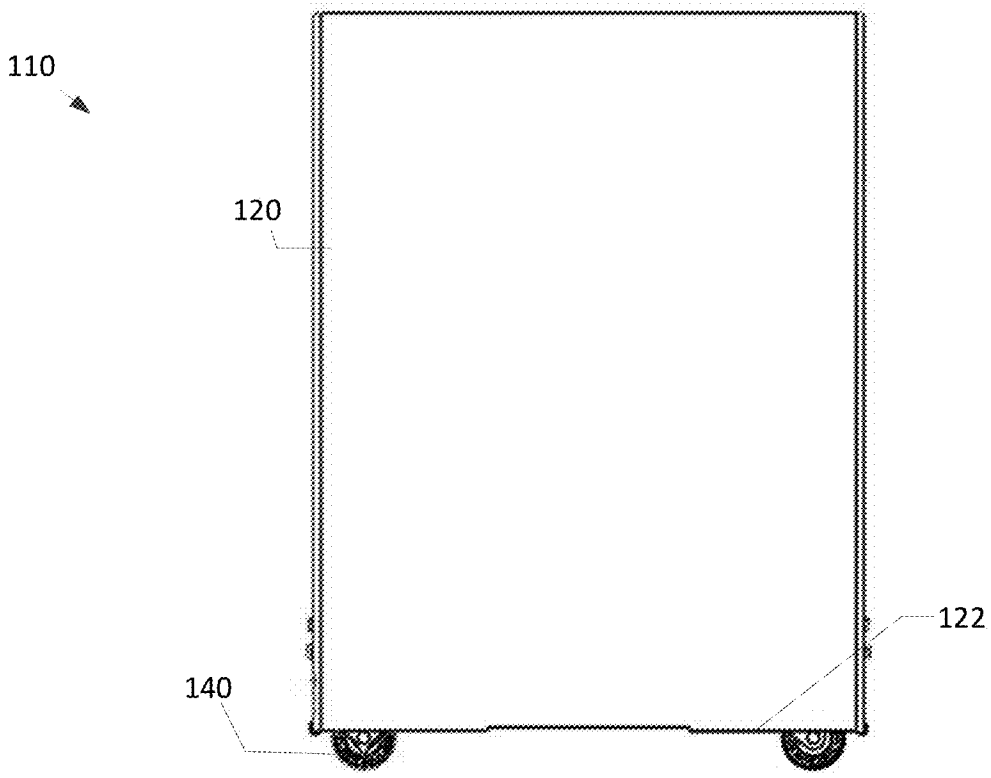
FIG. 3F depicts a front view of an example barrier with a shield in a retracted position.
Figure 4A:
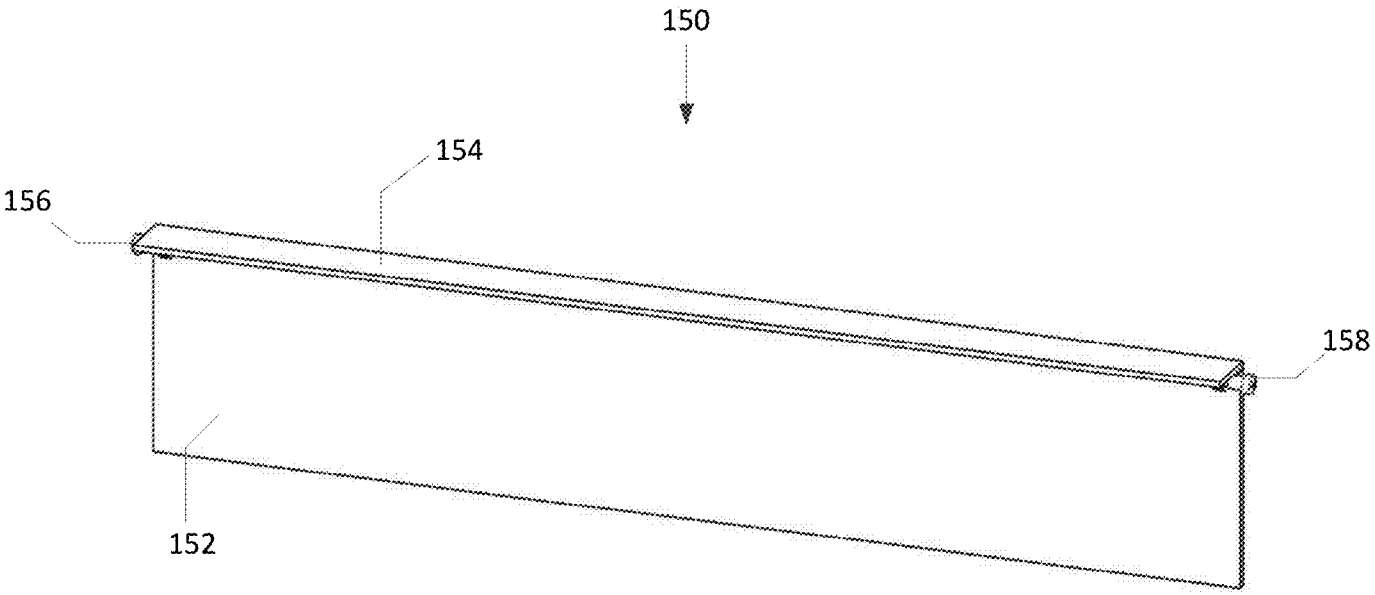
FIG. 4A depicts a rear perspective view of an example shield in isolation.
Figure 4B:
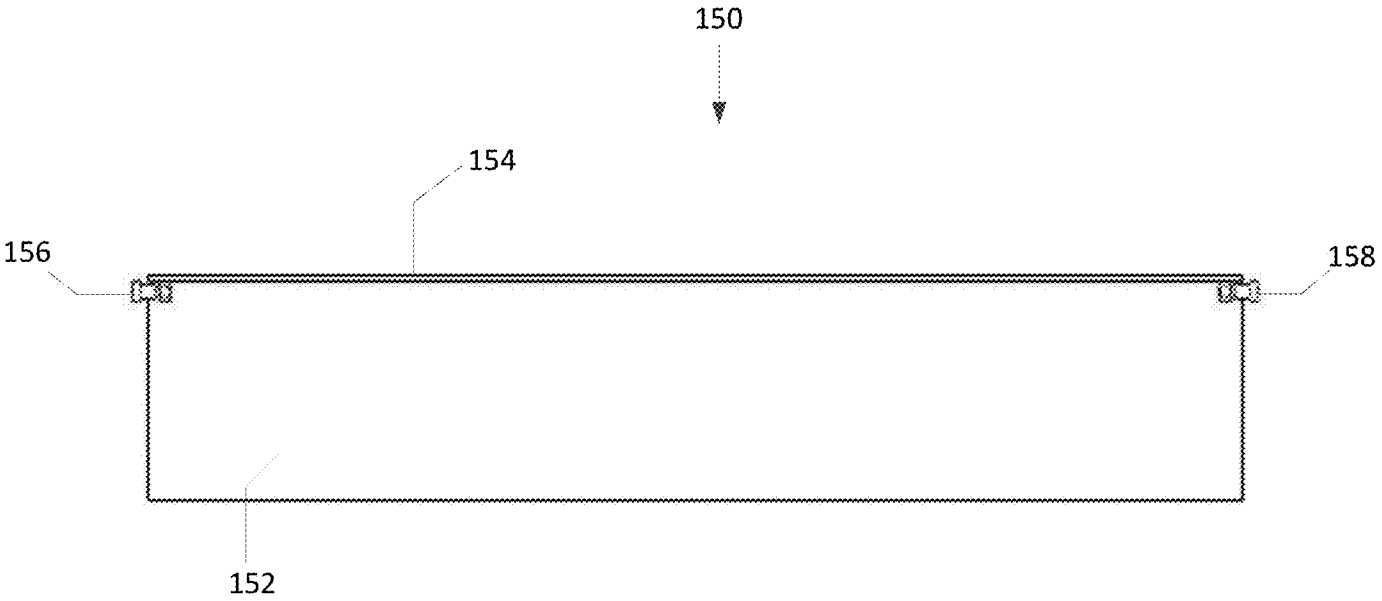
FIG. 4B depicts a rear view of an example shield in isolation.
Figure 4C:
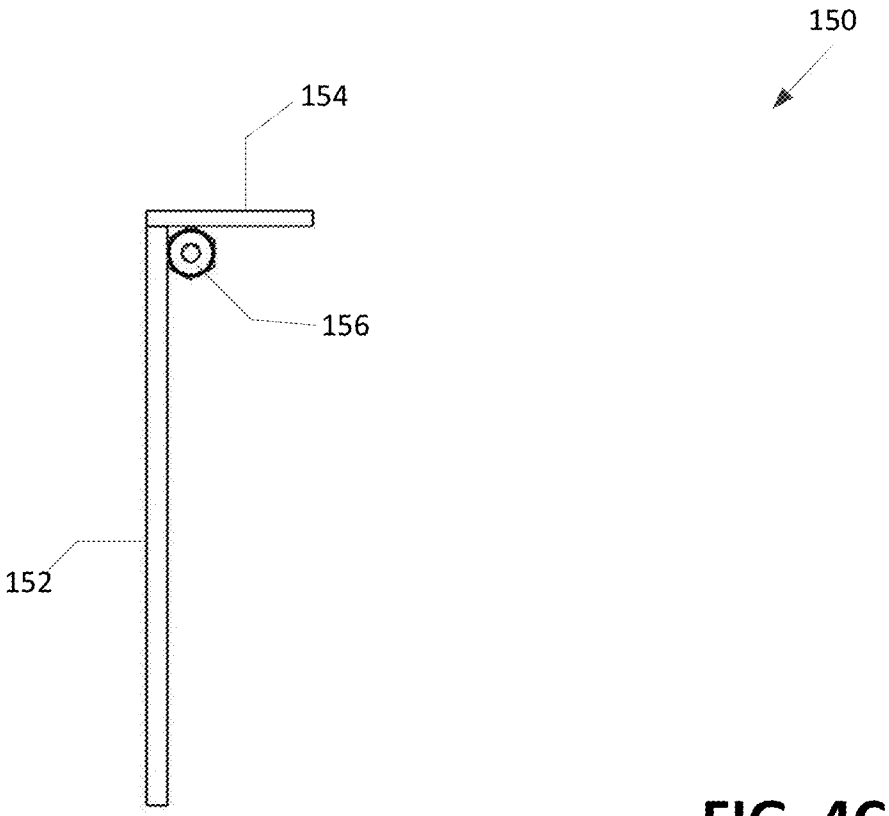
FIG. 4C depicts a side view of an example shield in isolation.
Figure 4D:
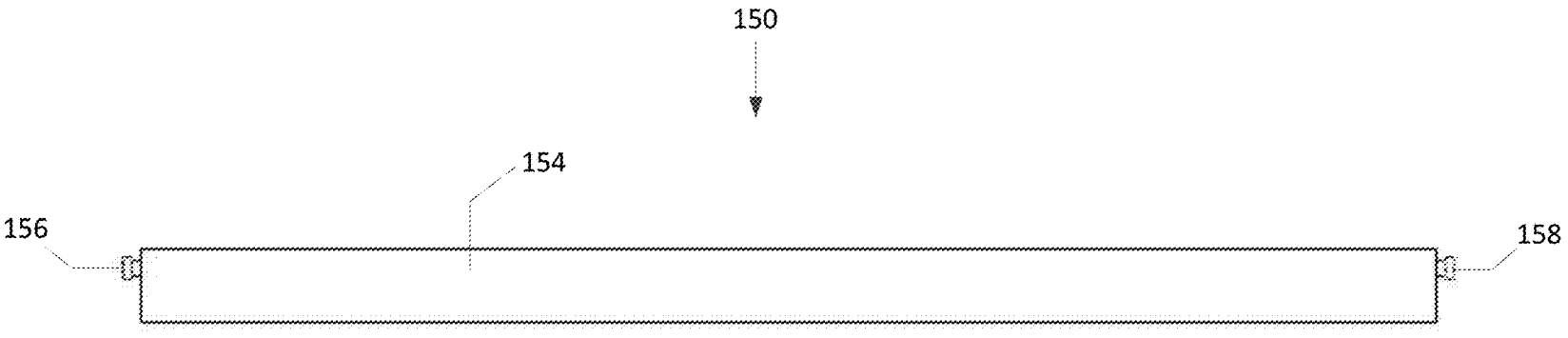
FIG. 4D depicts a front view of an example shield in isolation.
Figure 5A:
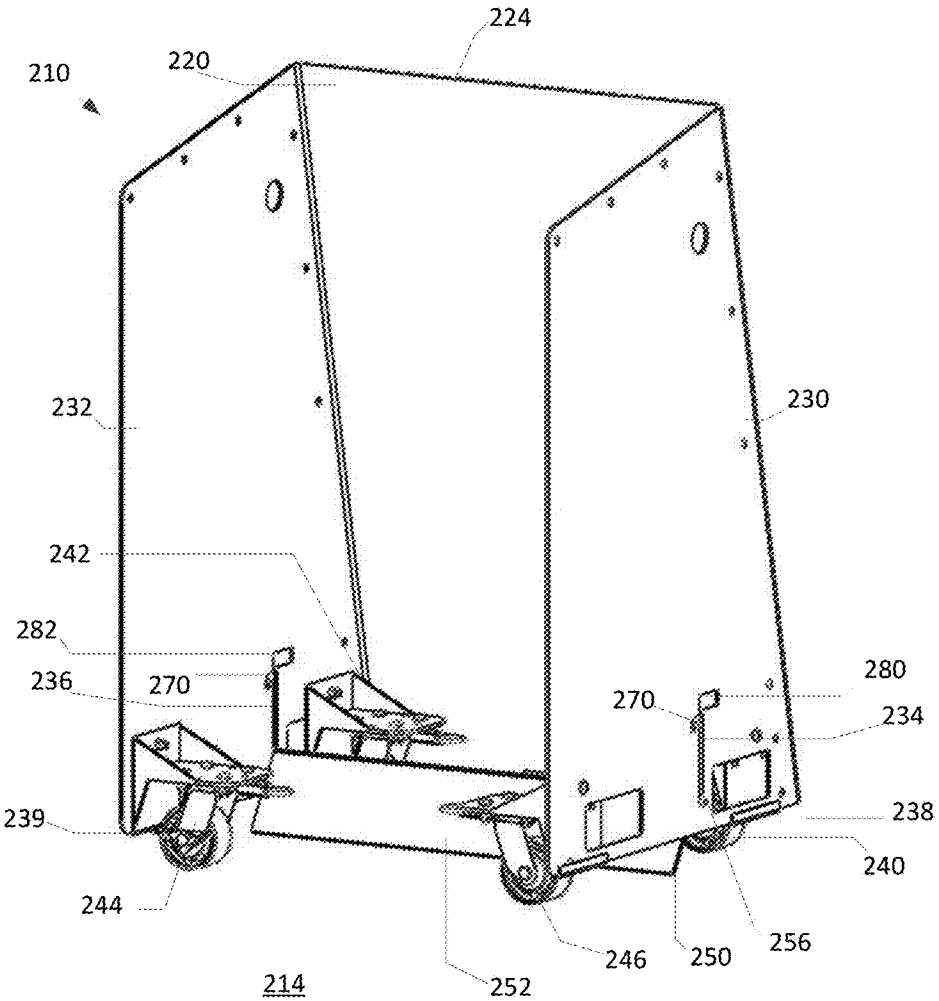
FIG. 5A depicts a rear perspective view of an example barrier with a shield in an extended position.
Figure 5B:
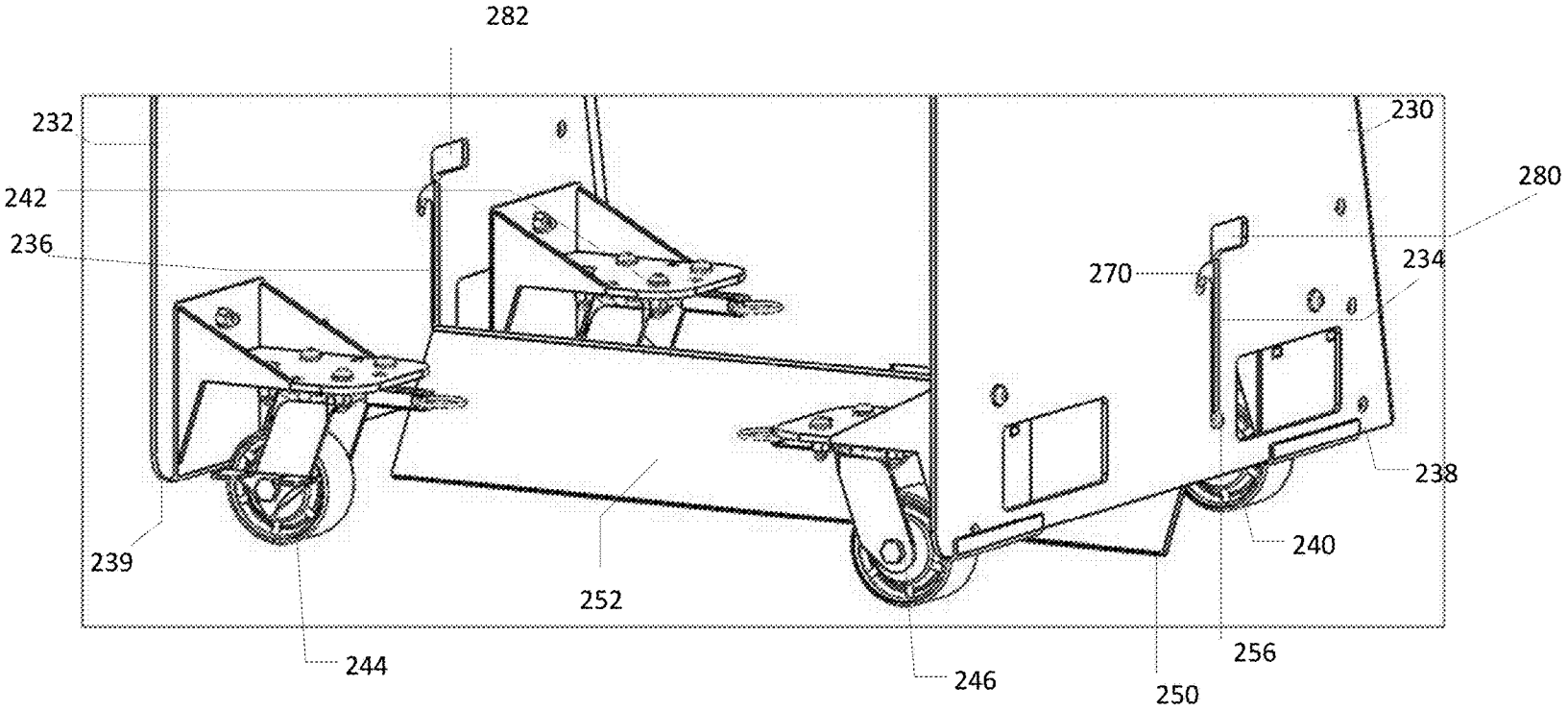
FIG. 5B depicts an isolated rear perspective view of an example barrier with a shield in an extended position.
Figure 5C:
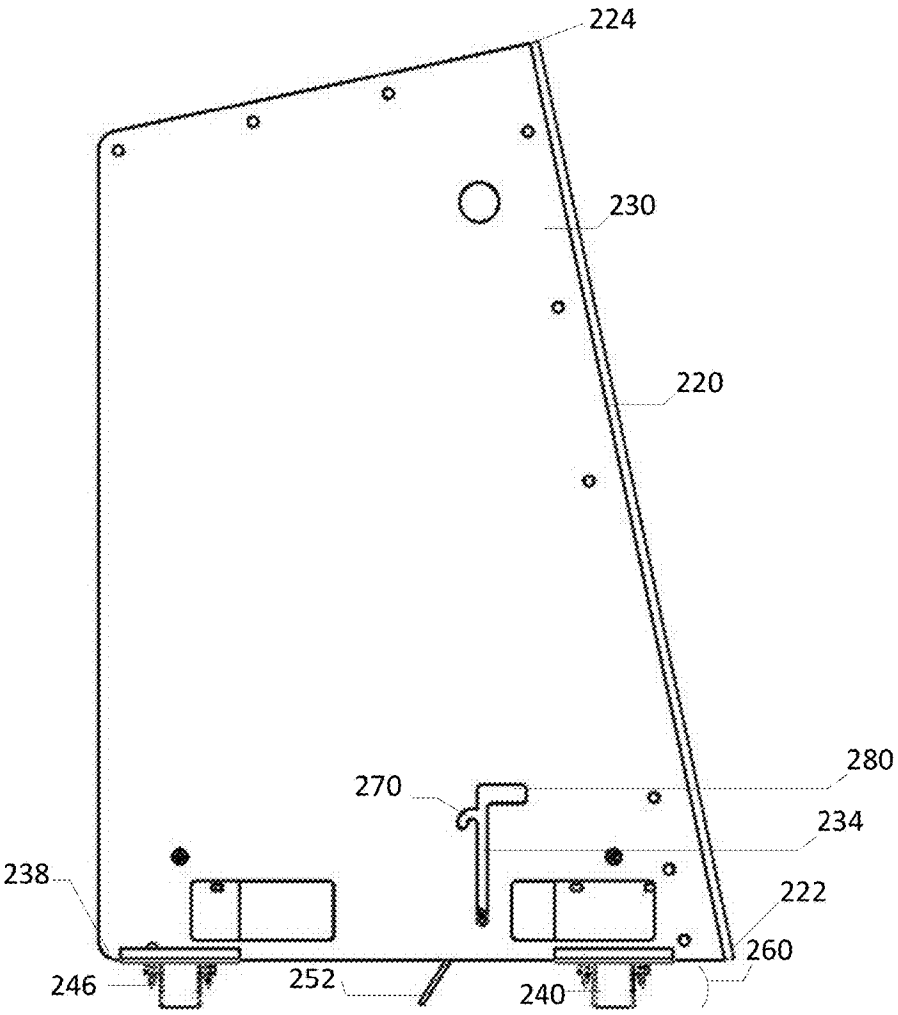
FIG. 5C depicts a side view of an example barrier with a shield in an extended position.
Figure 5D:
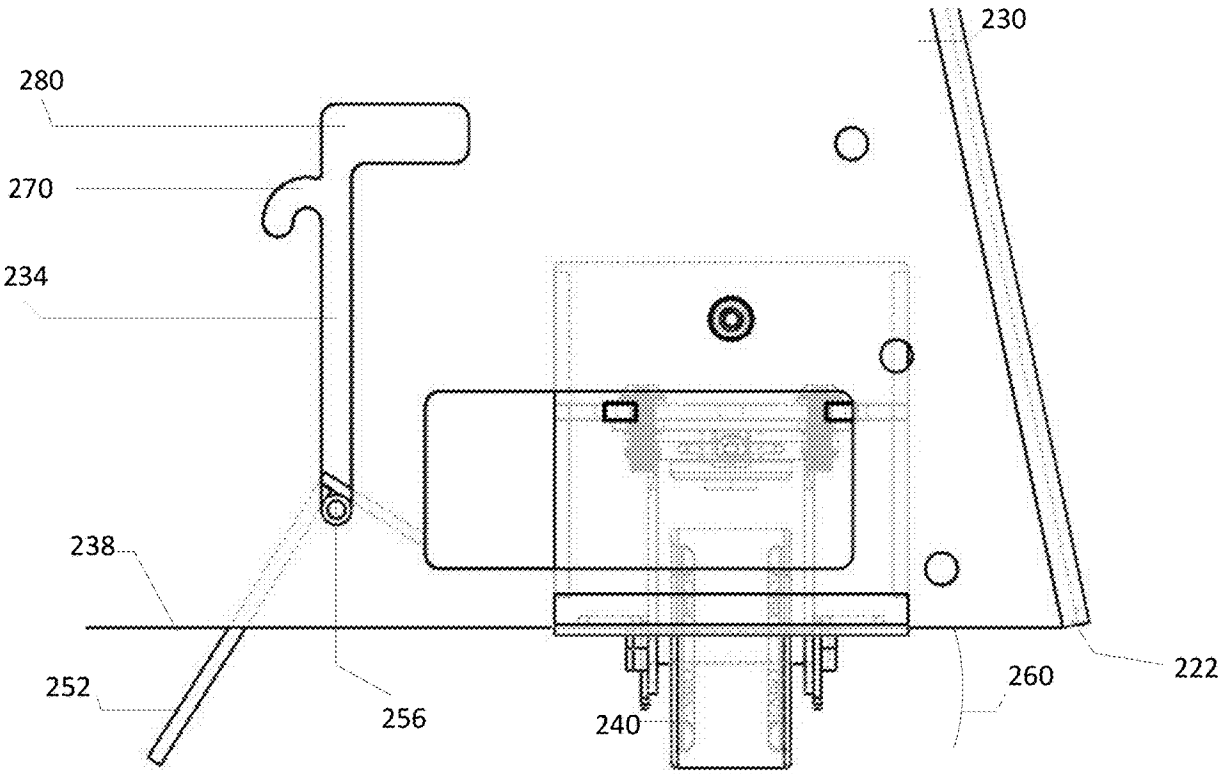
FIG. 5D depicts a side view, partially in transparency, of an example barrier with a shield in an extended position.
Figure 5E:
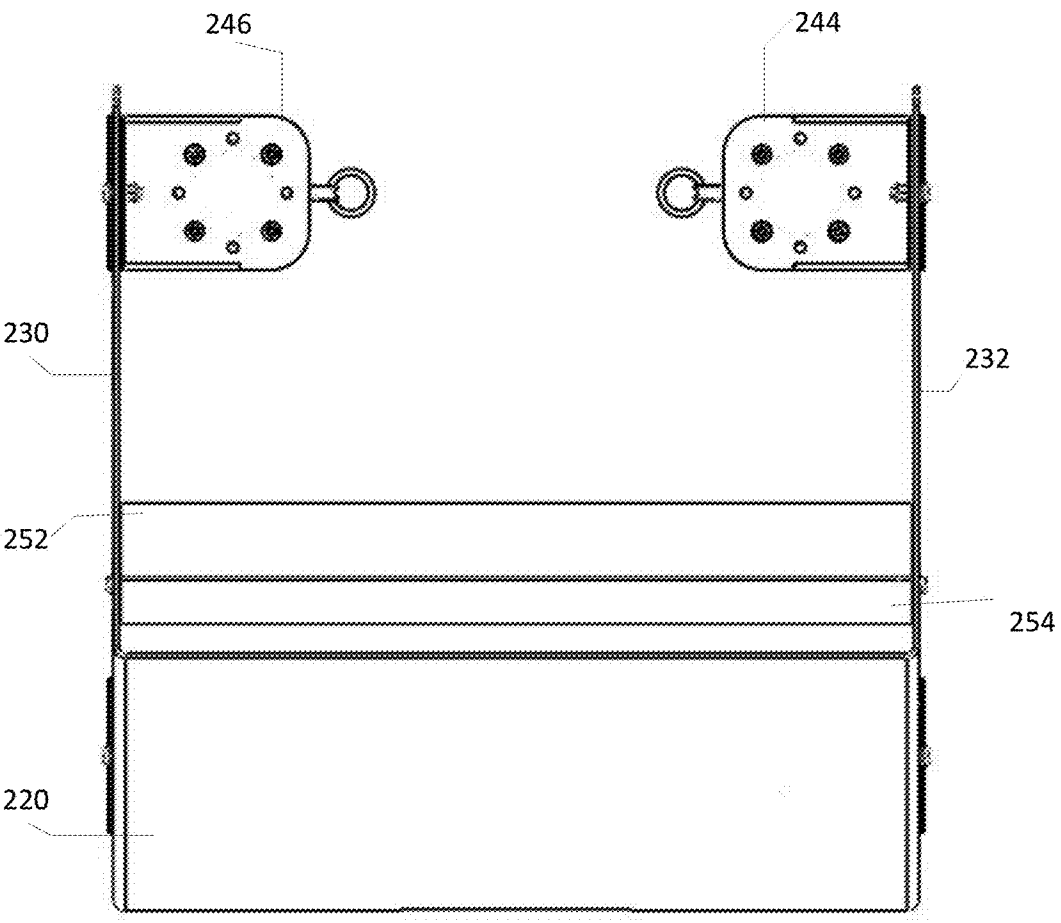
FIG. 5E depicts a top view of an example barrier with a shield in an extended position.
Figure 5F:
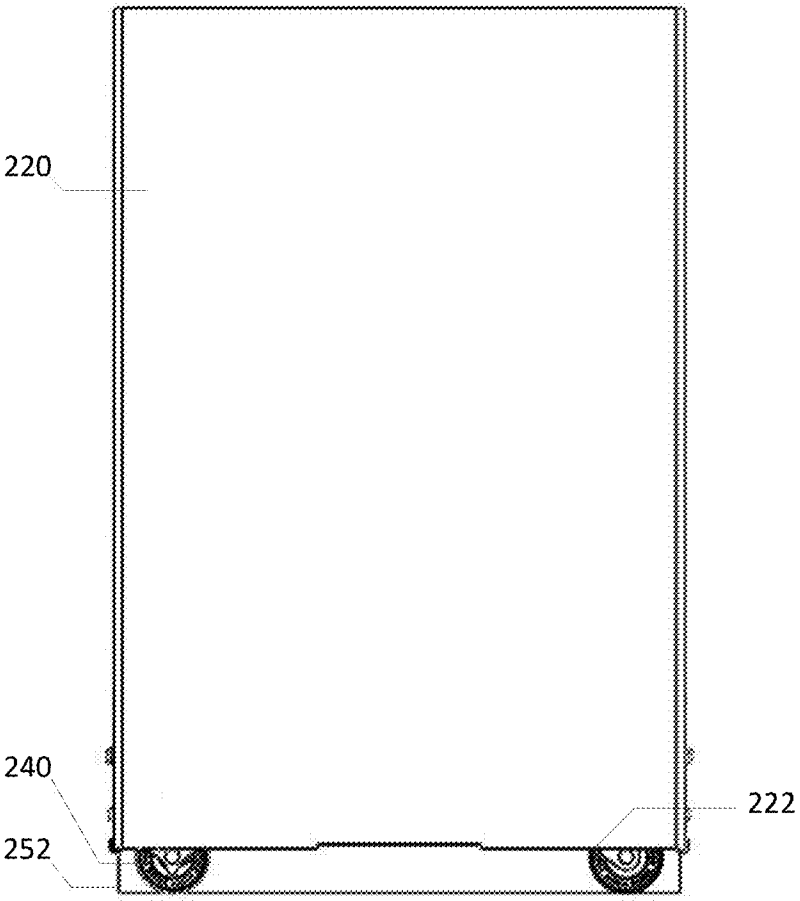
FIG. 5F depicts a front view of an example barrier with a shield in an extended position.
Figure 6A:
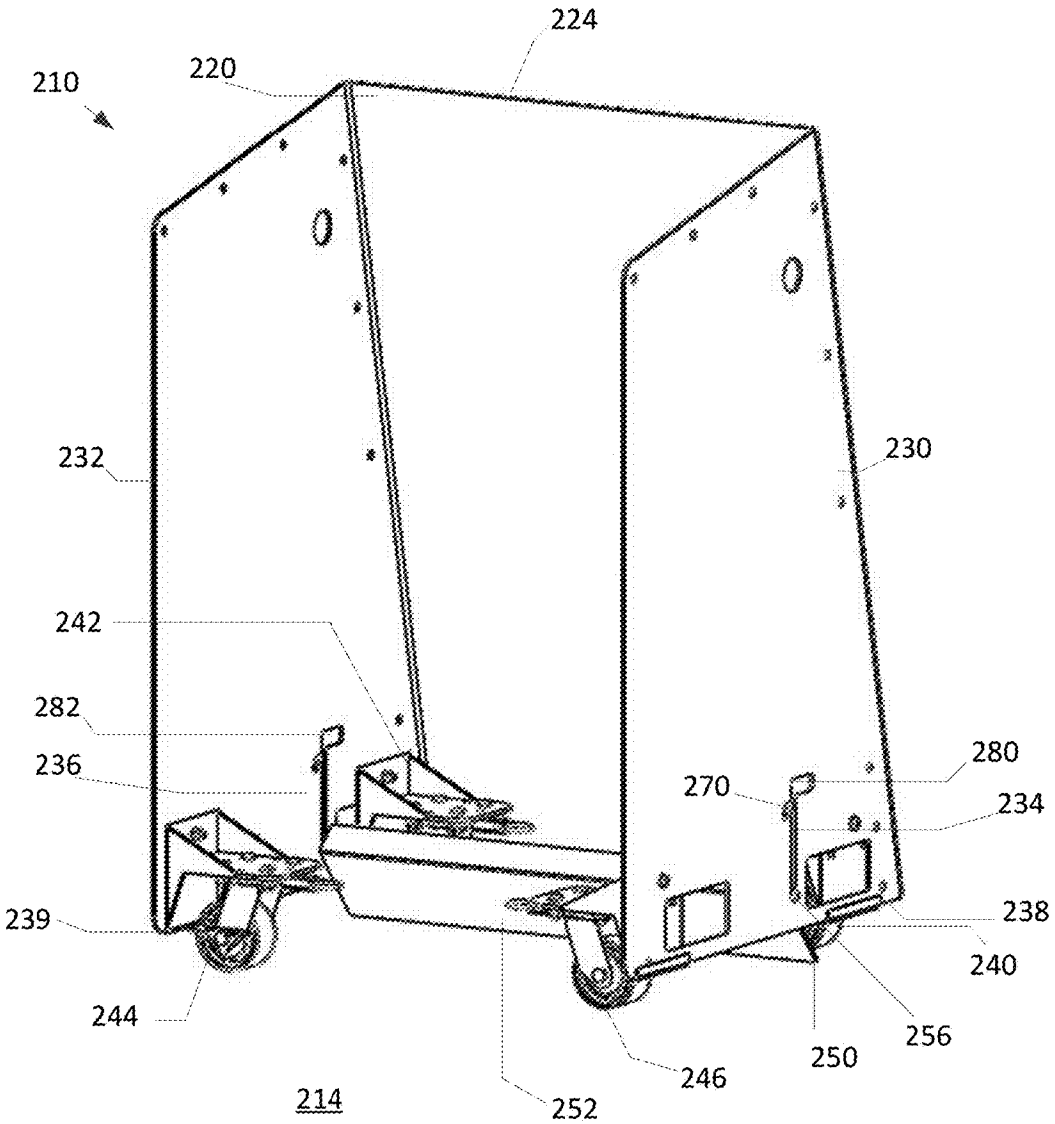
FIG. 6A depicts a rear perspective view of an example barrier with a shield in an extend position.
Figure 6B:
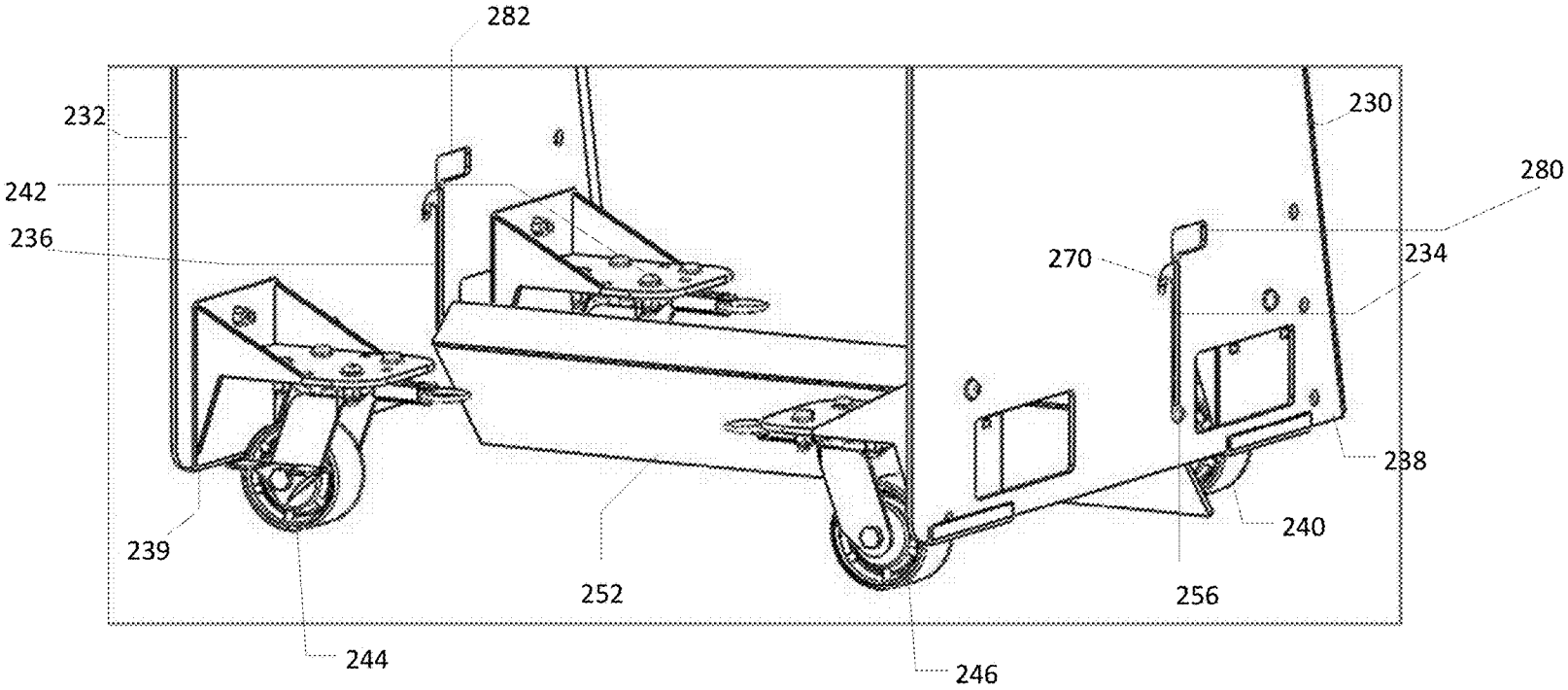
FIG. 6B depicts an isolated rear perspective view of an example barrier with a shield in an extended position.
Figure 6C:
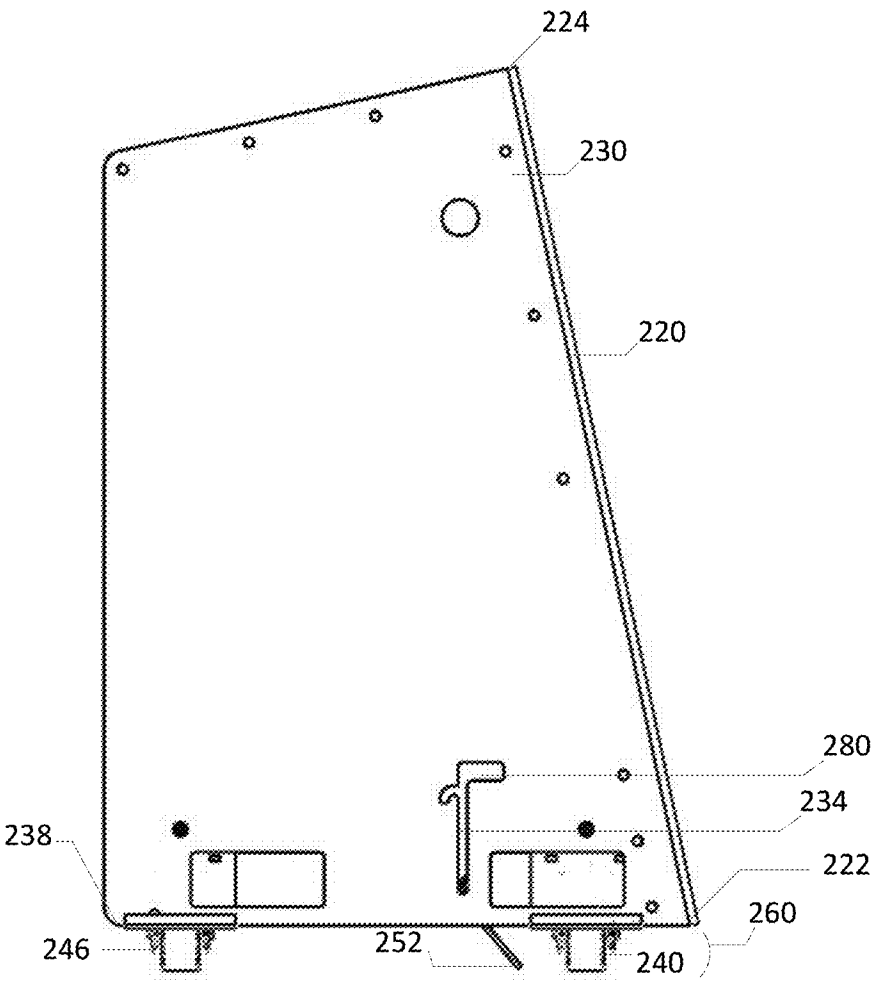
FIG. 6C depicts a side view of an example barrier with a shield in an extended position.
Figure 6D:
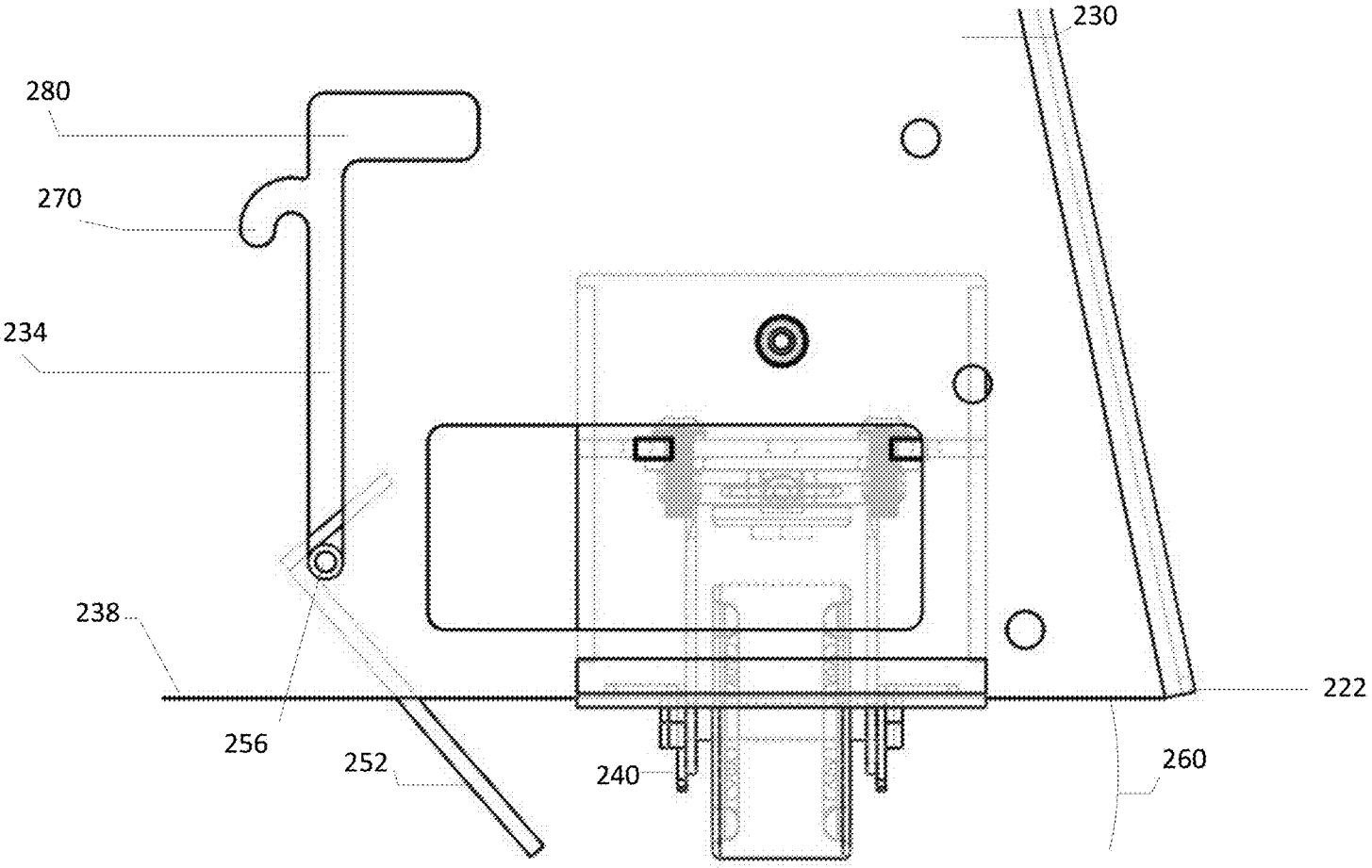
FIG. 6D depicts a side view, partially in transparency, of an example barrier with a shield in an extended position.
Figure 6E:
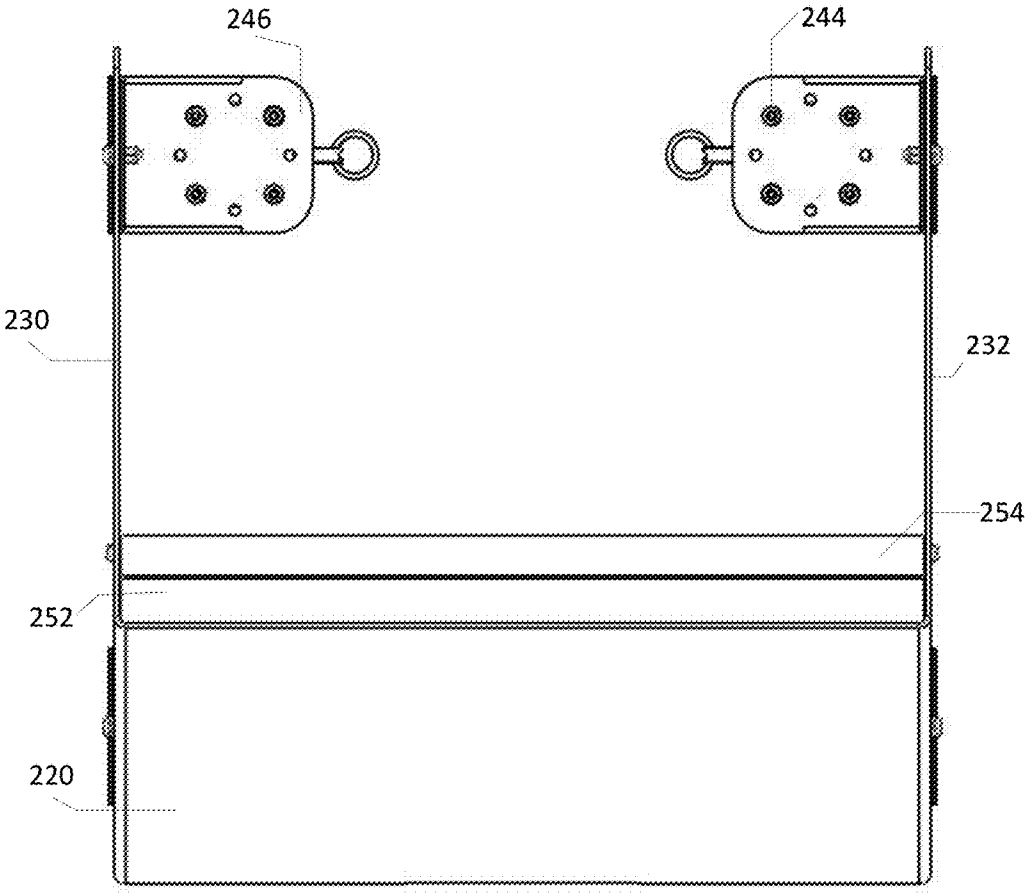
FIG. 6E depicts a top view of an example barrier with a shield in an extended position.
Figure 6F:
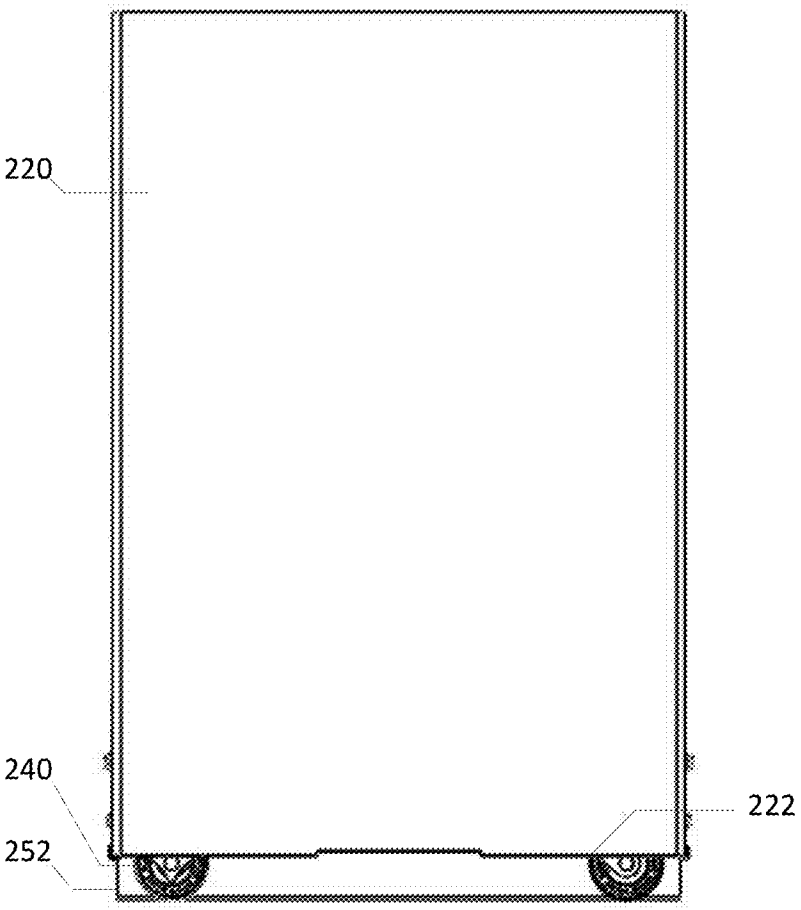
FIG. 6F depicts a front view of an example barrier with a shield in an extended position.

FIGS. 3A-F illustrate shield 150 in a retracted position. As shown, in a retracted position, retention members 156 and 158 are positioned in recesses 134 and 136 at a position relatively remote from bottom edges 138 and 139 of side walls 130 and 132. As shown in FIG. 3D, recesses 134 and 136 (not illustrated) may be configured to maintain retention members 156 and 158 at a location in the recesses remote from bottom edges 138 and 139. In the illustrated embodiments, recesses 134 and 136 extend upward, curve, and terminate in an area 170 that is adapted to support and at least partially immobilize or secure retention members 156 and 158 at a location within recesses 134 and 136. By fixing or immobilizing retention members 156 and 158, the entirety of shield 150 is fixed vertically relative to the remainder of barrier 120. In the example embodiment, in the retracted position, first planar portion 152 extends downward substantially perpendicular to supporting surface 114. In the retracted position, first planar portion 152 is raised above supporting surface 114. Accordingly, in the retracted position, shield 150 provides clearance to accommodate movement of barrier 110 in any direction without any interference by or movement of shield 150. In an example embodiment, shield 150 may be positioned as in FIGS. 3A-F by manual human intervention.

FIGS. 5A-F, 6A-F, 7A-F, and 8A-D depict another example barrier system with shield. The barrier system depicted in FIGS. 5-8 operates similarly to those systems described above, but comprises additional features. For example, the barrier system depicted in FIGS. 5-8 comprises additional wheel systems 244 and 246 which facilitate mobility. Side walls 230 and 232 may have a different configuration or shape as compared to the sidewalls described in connection with FIGS. 1-3. Additionally, recesses 234 and 236 have a different configuration as compared to recesses 134 and 136 depicted in FIGS. 1-3. More particularly, recesses 234 and 236 comprise enlarged areas 280 and 282, respectively, adapted to be used in mounting shield 250 within recesses 234 and 236.

FIGS. 5A-F depict an example barrier system with a shield in an extended position. As shown, barrier 210 comprises a front wall 220 having a lower edge 222 and an upper edge 224. The front wall extends in a substantially upward direction relative to the supporting surface 214. Front wall is adapted to prevent projectiles that strike the first side of the front wall from penetrating through to the second side. In an example embodiment, front wall 220 may be an armored panel or wall formed from materials such as metal, masonry, and/or carbon fiber capable of withstanding ballistics and blast projectiles.

Side panels or walls 230 and 232 extend from front wall 220 and operate to stabilize front panel 224 and maintain barrier 210 in an upright position. Side walls 230 and 232 extend upward from supporting surface 214 and are rigidly coupled to front wall 224. In an example embodiment, front wall 224 leans toward side walls 230 and 232 such that at least part of the weight of front wall 224 is supported by side walls 230 and 232. Side walls 230 and 232 extend upward from lower edges 238 and 239, respectively. Side walls 230 and 232 are adapted to prevent projectiles that strike the walls from penetrating from an exterior first side through to a protected second side. In an example embodiment, side walls 230 and 232 may be an armored panel or wall formed from materials such as metal, masonry, and/or carbon fiber capable of withstanding ballistics and blast projectiles.

In an example embodiment, barrier 210 further comprises wheel systems 240, 242, 244, and 246 which facilitate movement of barrier 110. In an example embodiment, wheel systems 240, 242, 244, and 246 may be casters with wheels that swivel. Wheel systems 240, 242, 244, and 246 may be attached to side walls 230 and 232 in any suitable manner.

For example, wheel systems 240, 242, 244, and 246 may form brackets that receive side walls therein and form a frictional fit with the side walls. In an example embodiment, wheel systems 240, 242, 244, and 246 may be attached to barrier 210 so as to be easily removed, possibly without use of tools. Wheel systems 240, 242, 244, and 246 extend below lower edges 238 and 239 of side walls 230 and 232 and below lower edge 222 of front wall 224. Wheels that are part of wheel systems 240, 242, 244, and 246 contact supporting surface 214 and support at least a portion of the weight of barrier 210. When wheels of wheel systems 230 and 232 contact supporting surface 214, a gap is formed between the supporting surface and the lower edges 222, 238, and 239.

Barrier 210 further comprises shield 250 which is adapted to be moved between an extended position and a retracted position. In an extended position, as illustrated in FIGS. 5A-F and 6A-F, shield 250 abuts supporting surface 214 and extends upward from adjacent supporting surface 214 to a height at least equal to gap 260 formed between lower edge 222 of front wall 224 and supporting surface 214. In a retracted position, as illustrated in FIGS. 7A-F, shield 250 is withdrawn relative to the supporting surface.

In an example embodiment, and as illustrated in FIGS. 8A-D, shield 250 comprises a first planar portion 252 and a second planar portion 254. Second planar portion 254 intersects with and extends from first planar portion 252 at an angle, which may be, for example, an approximately ninety (90) degree angle. In an example embodiment, first planar portion 252 is longer than second planar portion 254. Shield 250 is adapted to prevent projectiles that strike panels 252 and 254 from penetrating from an exterior first side through to a protected second side. In an example embodiment, shield 250 may be armored and formed from materials such as metal, masonry, and/or carbon fiber capable of withstanding ballistics and blast projectiles.

Shield 250 further comprises a first retention member 256 and a second retention member 258 which extend from opposing sides of shield 250. In an example embodiment, retention members 256 and 258 extend from opposing sides of shield proximate the location the first planar portion 252 and second planar portion 254 intersect. Retention members 256 and 258 are received in corresponding recesses 234 and 236 formed in side walls 230 and 232. Recesses 234 and 236 may be elongated and extend upward from a location proximate bottom edges 238 and 239 of side walls 230 and 232, to a location further removed or remote from bottom edges 238 and 239. When shield 250 is in the extended position abutting supporting surface 214, retention members 256 and 258 are located at or near the portion of recesses 234 and 236 closest to bottom edges 238 and 239. As illustrated in FIGS. 7A-F, when shield 250 is in its retracted position, retention members 256 and 258 are in recesses 234 and 236, but are removed to a location relatively remote from lower edges 238 and 239 of side walls. It will be appreciated that retention members 256 and 258 may travel within recesses 234 and 236 in response to forces applied to shield 250 and/or barrier 210. Retention members 256 and 258 may be pivotally moveable relative to recesses 234 and 236. Accordingly, shield 250 may be pivoted about retention members 256 and 258, which may pivot within recesses 234 and 236.

First planar portion 252 of shield 250 extends between side walls 230 and 232 and slopes downward from a height corresponding to the location of retention members 256 and 258 in recesses 234 and 236 to a position adjacent to supporting surface 214. As illustrated in FIGS. 5A-F, first planar portion 252 may be positioned to slope down and away relative to front wall 220. Second planar portion 254 extends at approximately a ninety-degree angle to first planar portion 252 and extends downward and toward front wall 220. In the position shown in FIGS. 5A-F, barrier 110 may be moved forward while shield 150 is in its extended position. The sloping arrangement of first planar portion 252 accommodates movement of the shield over supporting surface 214 in instances when barrier 210 is moved forward. If barrier 210 is moved backward while shield 250 is positioned as in FIGS. 5A-F, the motion of shield 250 may be impeded by friction with supporting surface 214. In such a scenario, shield 250 may remain substantially in a fixed position relative to the remainder of barrier 210. Retention members 256 and 258 slide upward in recesses 234 and 236 as shield 250 remains substantially in a fixed position relative to the remainder of barrier 210 which may move backward. As retention members 256 and 258 slide upward in recesses 234 and 236, first planar portion 252 assumes an increasingly steep angle relative to supporting surface 214. If movement of barrier 210 relative to shield 250 continues, first planar portion 252 may assume a position wherein it slopes toward front wall 220 as illustrated in FIGS. 6A-F.

As shown in FIGS. 6A-F, first planar portion 252 may be positioned to extend from its location in recesses 234 and 236 toward supporting surface 214. First planar portion 252 slopes down and toward front wall 220. In the position shown in FIGS. 6A-F, barrier 210 may be moved backward while shield 250 is in its extended position. The sloping arrangement of first planar portion 252 accommodates movement of shield 250 over supporting surface 214 when barrier 210 is moved backward. However, if shield 250 is positioned to slope toward front wall 220 as shown in FIGS. 6A-F and barrier 210 is moved forward, shield 250 may remain substantially in a fixed position relative to the remainder of barrier 210 due to friction between shield 250 and supporting surface 214. Retention members 256 and 258 slide upward in recesses 234 and 236 as shield 250 remains substantially in a fixed position relative to the remainder of barrier 210. As retention members 256 and 258 slide upward in recesses 234 and 236, first planar portion 252 assumes an increasingly steep angle relative to supporting surface 214. If movement of barrier 210 relative to shield 250 continues, first planar portion 252 may assume a position wherein it slopes away from front wall 220 as illustrated in FIGS. 5A-F. It will be appreciated that shield 250 may move between positions illustrated in FIGS. 5A-F and FIGS. 6A-F as barrier 210 is moved forward and backward. In both positions, shield 250 provides protection from projectiles and spall that may enter upon a gap 260 between lower edge 222 of front wall 220 and supporting surface 214.

Figure 7A:
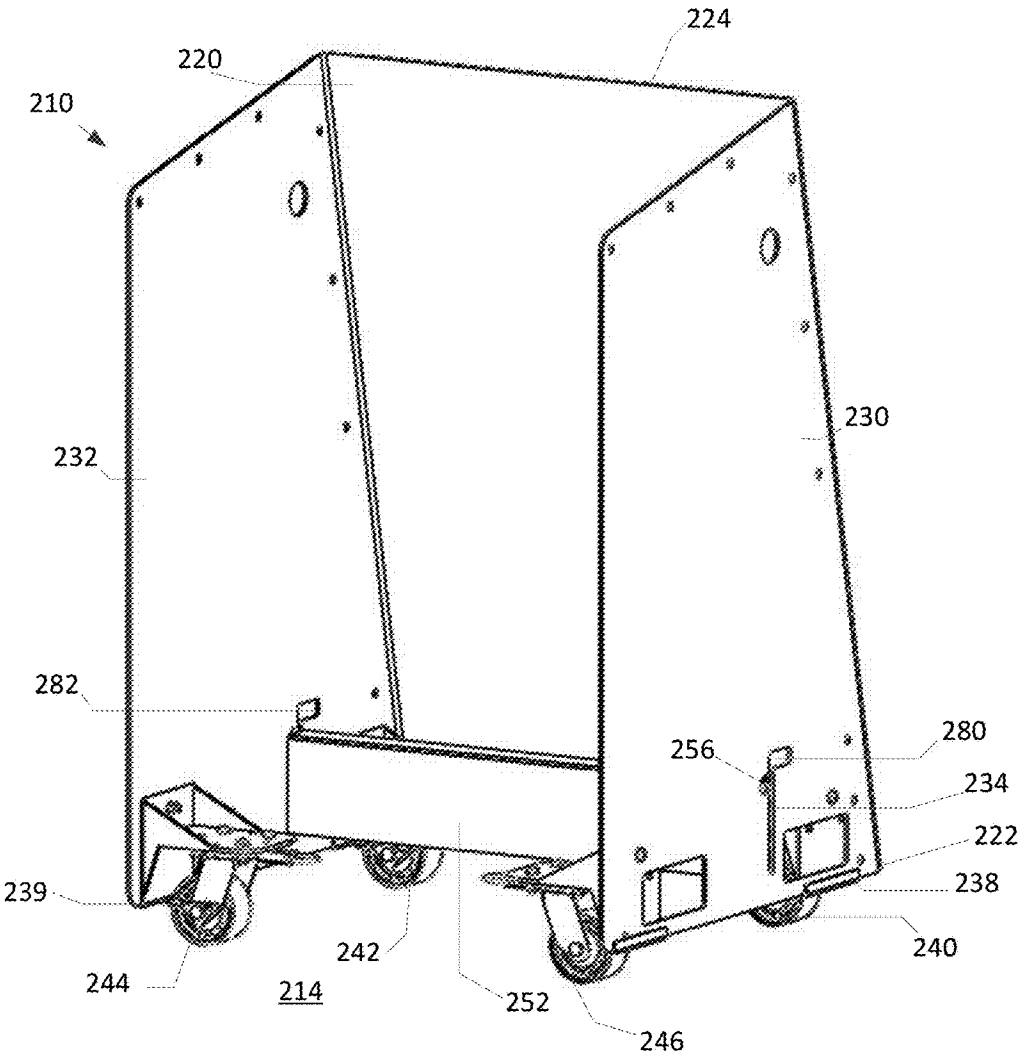
FIG. 7A depicts a rear perspective view of an example barrier with a shield in a retracted position.
Figure 7B:
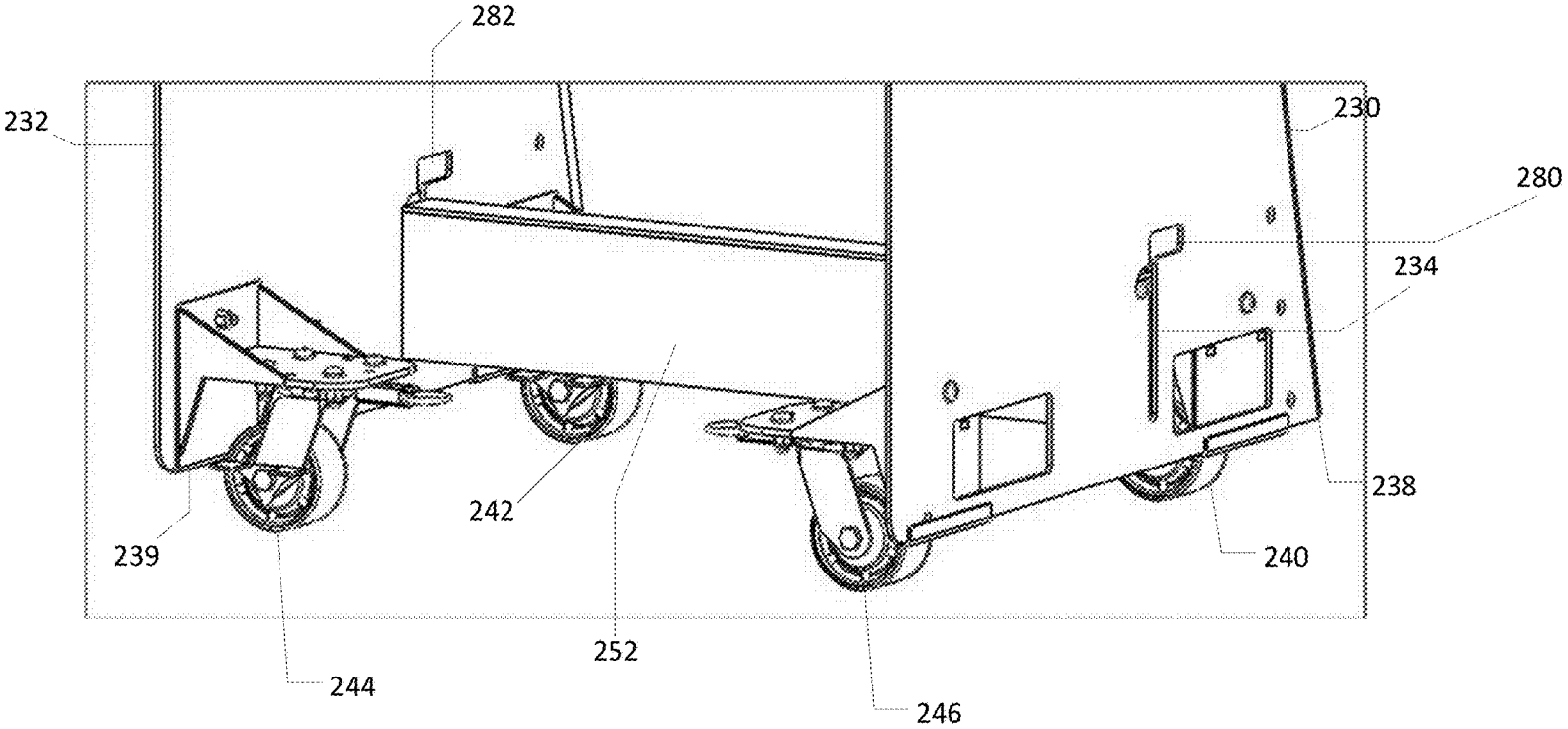
FIG. 7B depicts an isolated rear perspective view of an example barrier with a shield in a retracted position.
Figure 7C:
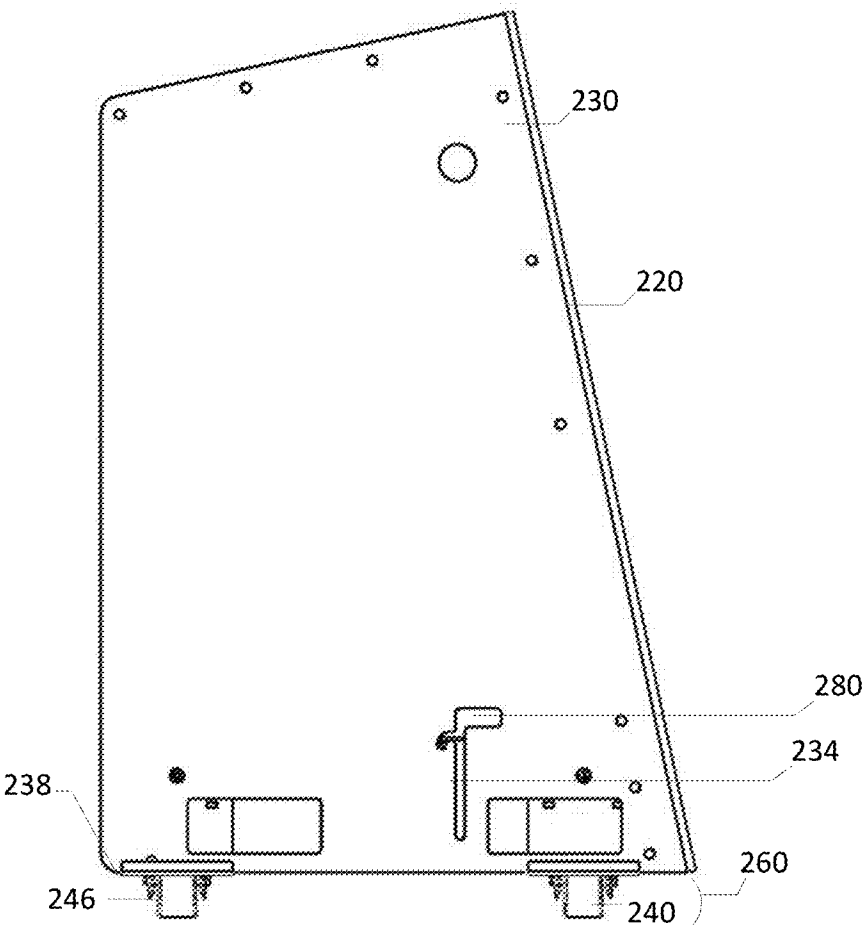
FIG. 7C depicts a side view of an example barrier with a shield in a retracted position.
Figure 7D:
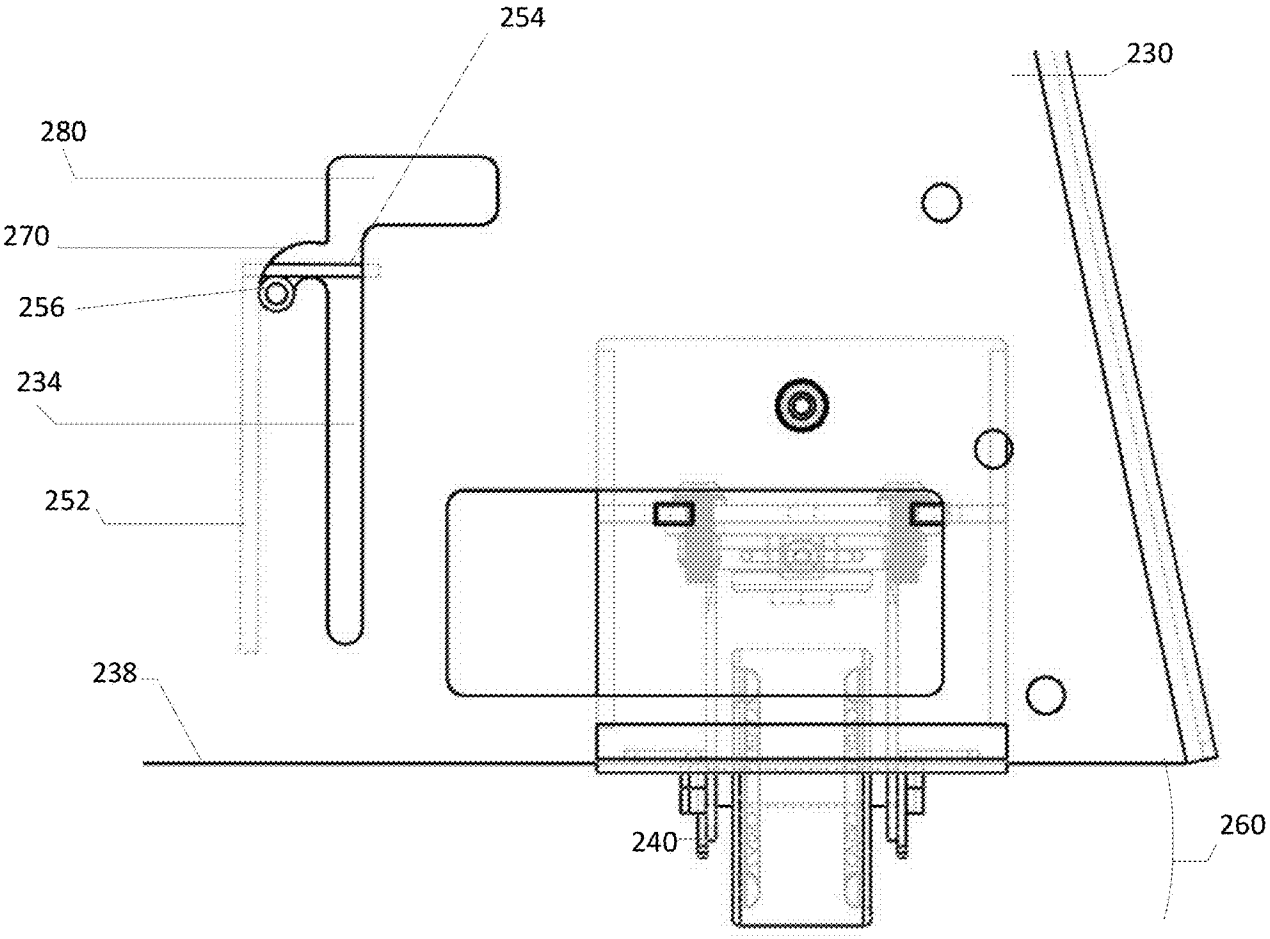
FIG. 7D depicts a side view, partially in transparency, of an example barrier with a shield in a retracted position.
Figure 7E:
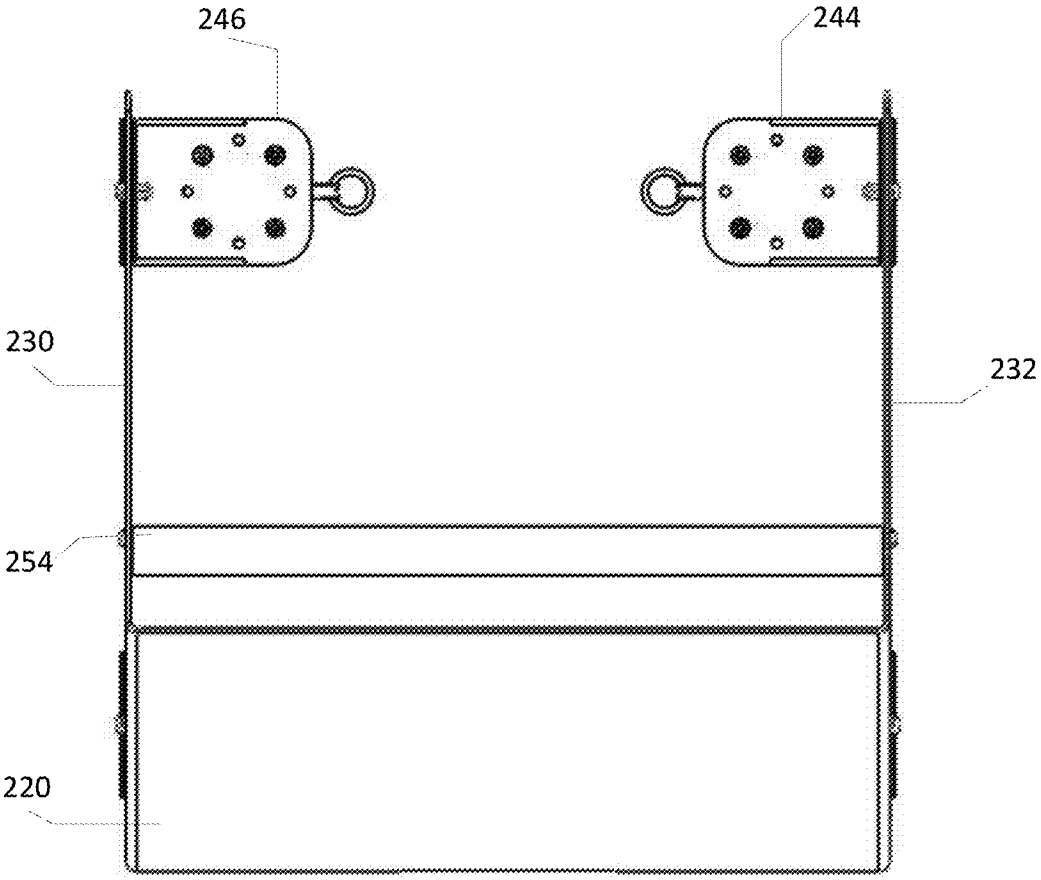
FIG. 7E depicts a top view of an example barrier with a shield in a retracted position.
Figure 7F:
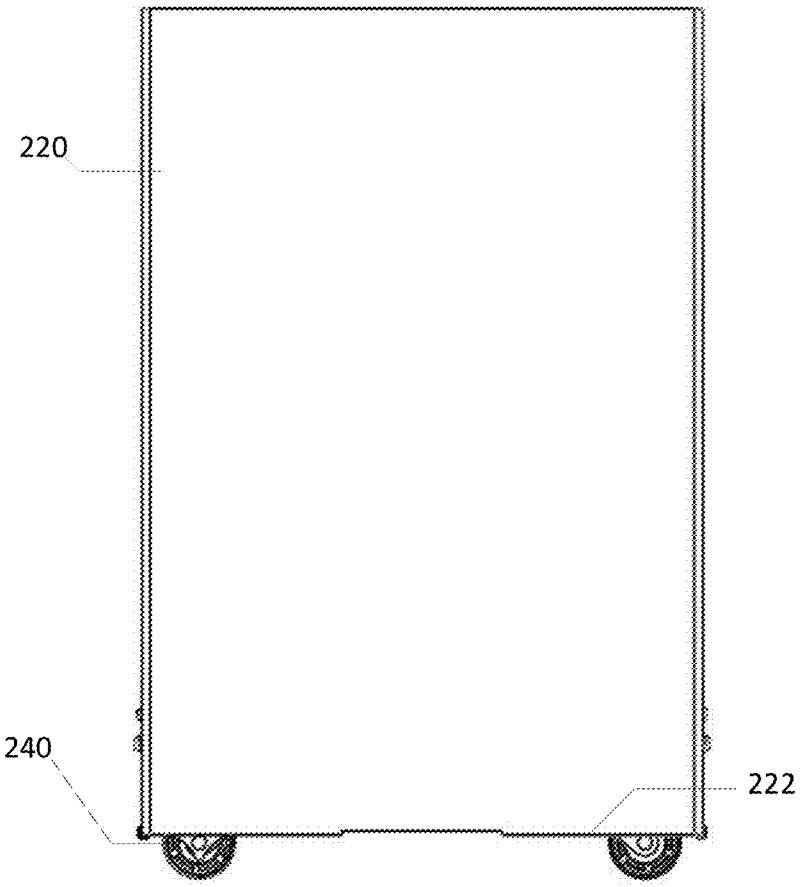
FIG. 7F depicts a front view of an example barrier with a shield in a retracted position.
Figure 8A:
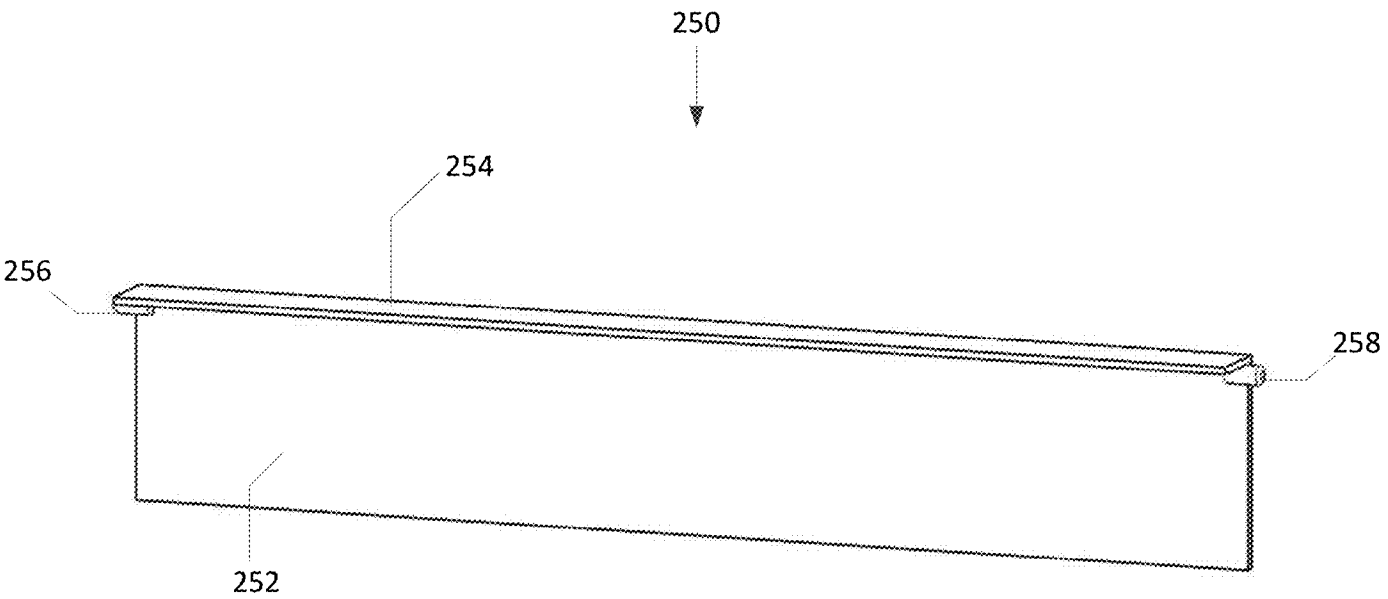
FIG. 8A depicts a rear perspective view of an example shield in isolation.
Figure 8B:
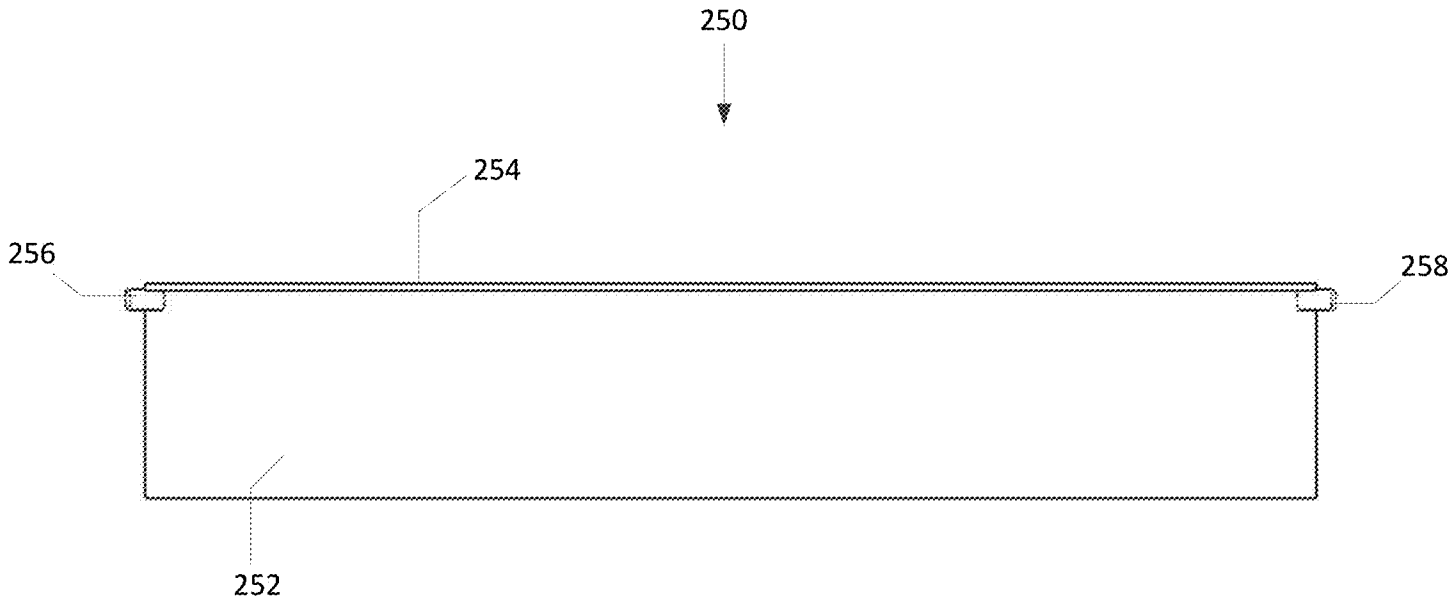
FIG. 8B depicts a rear view of an example shield in isolation.
Figure 8C:
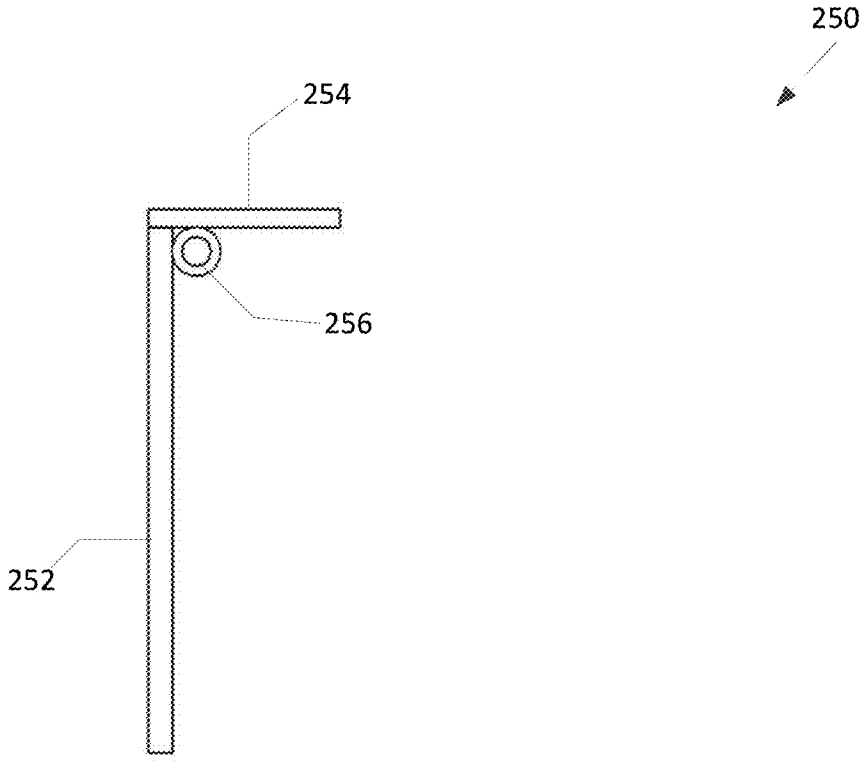
FIG. 8C depicts a side view of an example shield in isolation.
Figure 8D:
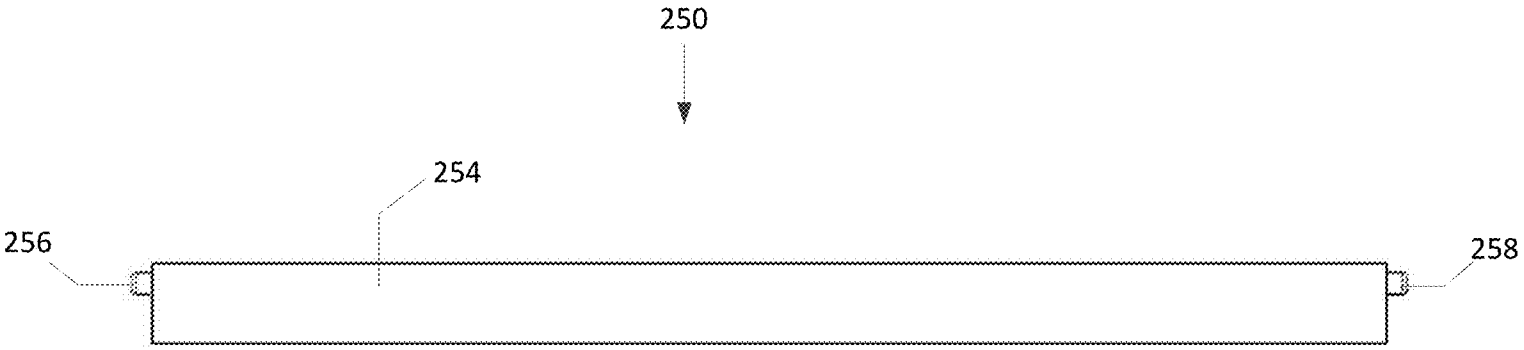
FIG. 8D depicts a front view of an example shield in isolation.

FIGS. 7A-F illustrate shield 250 in a retracted position. As shown, in a retracted position, retention members 256 and 258 are positioned in recesses 234 and 236 at a position relatively remote from bottom edges 238 and 239 of side walls 230 and 232. As shown in FIG. 7D, recesses 234 and 236 (not illustrated) may be configured to maintain retention members 256 and 258 at a location in the recesses remote from bottom edges 238 and 239. In the illustrated embodiments, recesses 234 and 236 extend upward, curve, and terminate in an area 270 that is adapted to support and at least partially immobilize or secure retention members 256 and 258 at a location within recesses 234 and 236. By fixing or immobilizing retention members 256 and 258 in area 270, the entirety of shield 250 is fixed vertically relative to the remainder of barrier 220. In the example embodiment, in the retracted position, first planar portion 252 extends downward substantially perpendicular to supporting surface 214. In the retracted position, first planar portion 252 is raised above supporting surface 214. Accordingly, in the retracted position, shield 250 provides clearance to accommodate movement of barrier 210 in any direction without any interference by or movement of shield 250. In an example embodiment, shield 250 may be positioned as in FIGS. 7A-F by manual human intervention.

Recesses 234 and 236 comprise mounting areas 280 and 282, respectively. Mounting areas 280 and 282 are adapted to facilitate mounting retention members 256 and 258 within recesses 234 and 236. For example, mounting areas 280 and 282 may be sized so that the retention members 256 and 258 may be easily positioned in recesses 234 and 236. Retention members 256 and 258 may be positioned in recesses 234 and 236, for example, when mounting shield 250 to barrier 210, and when removing shield 250 from barrier 210. Mounting area 280 may be sized so that retention member 256 may be moved into and out of engagement with the first side wall 230. Likewise, mounting area 282 may be sized so that retention member 258 may be moved into and out of engagement with the second side wall 232. In an example embodiment, mounting areas 280 and 282 may have a rectangular shape with a profile that can easily accommodate retention members 256 and 258. Shield 250 may be mounted to the barrier system by positioning retention members 256 and 258 in mounting areas 280 and 282 and then moving retention members 256 and 258 into a narrower section of recesses 234 and 236. Shield 250 may be removed from the barrier system by moving shield 250 so that retention members 256 and 258 are removed from the narrower portion of recesses 234 and 236 and positioned within mounting areas 280 and 282. Mounting areas 280 and 282 are sized so as to provide clearance for retention members 256 and 258 to be removed from recesses 234 and 236 and thereby remove shield 250 from barrier 210. Mounting areas 280 and 282 may be formed at any suitable location within recesses 234 and 236. In an example embodiment, mounting areas 280 and 282 may be positioned at a distal end of recesses 234 and 236 respectively. The configuration of recesses 234 and 236 and mounting areas 280 and 282 may allow for securing of shield 250 to barrier 210 with ease. In an example embodiment, the arrangement and size of mounting areas 280 and 282 may allow for shield 250 to be mounted to, and removed from barrier system 210 without use of additional hardware or tools.

Accordingly, Applicant has disclosed a retractable shield for use with a defensive barrier. The shield that is movable between an extended position and a retracted position. In the extended position, the shield extends from the supporting surface to at least a height of a lower edge of a front wall of the shield. In the extended position, the shield provides protection in an area corresponding to any gap between the front wall and the supporting surface. In the retracted position, the shield is removed relative to the supporting surface and provides clearance from the supporting surface which might facilitate movement of the barrier.

It will be appreciated that while the shield has been described in the context of the example embodiments depicted in the figures, the potential embodiments is not limited to those depicted. For example, the shield may be employed with barrier systems of all types and configurations which may or may not be as depicted in the figures. Modifications may be made to the shield and the manner of interfacing with the barrier system depending upon the configuration of the particular barrier system.

Conditional language used herein, such as, among others, "can," "could," "might," "may," "e.g." and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having" and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some or all of the elements in the list.

The foregoing description is provided for the purpose of explanation and is not to be construed as limiting the potential embodiments. While the embodiments have been described with reference to preferred embodiments or preferred methods, it is understood that the words which have been used herein are words of description and illustration, rather than words of limitation. Furthermore, although the invention has been described herein with reference to particular structure, methods, and embodiments, the potential embodiments are not intended to be limited to the particulars disclosed herein, as the potential embodiments extend to all structures, methods and uses that are within the scope of the appended claims. Further, to the degree that advantages have been described that flow from the structure and methods; the potential embodiments are not limited to structure and methods that encompass any or all of these advantages. Those skilled in the relevant art, having the benefit of the teachings of this specification, may affect numerous modifications to the potential embodiments as described herein, and changes can be made without departing from the scope and spirit of the potential embodiments as defined by the appended claims. Furthermore, any features of one described embodiment can be applicable to the other embodiments described herein.

What is claimed is:

1. A barrier comprising:

a front wall having a lower edge and an upper edge, the front wall extending in a substantially upward direction relative to a supporting surface, the lower edge spaced apart from supporting surface and forming a gap between the lower edge and the supporting surface;

a first side wall extending at an angle from the front wall and extending upward from the supporting surface, the first side wall having a first elongated recess formed therein extending in a substantially upward direction;

a second side wall extending at an angle from the front wall and extending upward from the supporting surface, the second side wall having a second elongated recess formed therein extending in a substantially upward direction; and a shield movably attached to the first side wall and the second side wall, the shield movable between an extended position wherein the shield abuts the supporting surface and extends upward from adjacent the supporting surface to a height at least equal to a height of the gap formed between the lower edge of the front wall and the supporting surface, and a retracted position wherein the shield is withdrawn relative to the supporting surface, wherein a first element extends from the shield and is received in the first elongated recess, and a second element extends from the shield and is received in the second elongated recess, the first element being movable within the first elongated recess and the second element being movable within the second elongated recess.

2. The barrier of claim 1, wherein the first element is located at a first position in the first elongated recess when the shield is located in the extended position, and the second element is located at a first position in the second elongated recess when the shield is located in the extended position, and wherein the first element is located at a second position in the first elongated recess when the shield is located in the retracted position, and the second element is located at a second position in the second elongated recess when the shield is located in the retracted position.

3. The barrier of claim 2, wherein the first elongated recess extends from a location proximate the lower edge of the first side wall to a location relatively remote from the lower edge of the first side wall, wherein the second elongated recess extends from a position proximate the lower edge of the second side wall to a location relatively remote from the lower edge of the second side wall, wherein the first element is positioned at the location proximate the lower edge of the first side wall when the shield is in the extended position, and the second element is positioned at the location proximate the lower edge of the second side wall when the shield is in the extended position, and wherein the first element is positioned at the location relatively remote from the lower edge of the first side wall when the shield is in the retracted position, and the second element is located at the location relatively remote from the lower edge of the second side wall when the shield is in the retracted position.

4. The barrier of claim 3, wherein the shield comprises a first planar portion and a second planar portion, the second planar portion intersecting with and extending from first planar portion at an angle.

5. The barrier of claim 4, wherein the first element extends from the shield proximate a location the second planar portion intersects with the first planar portion, and the second element extends from the shield proximate a location the second planar portion intersects with the first planar portion.

6. The barrier of claim 5, wherein the first planar portion extends between the first element and the second element and extends toward the supporting surface, the first planar portion abutting the supporting surface when the shield is in the extended position.

7. The barrier of claim 6, wherein the first planar portion extends from the first element and the second element, toward the supporting surface, and away from the front wall when the shield is in the extended position.

8. The barrier of claim 7, wherein the first planar portion extends from the first element and the second element, toward the supporting surface, and toward the front wall when the shield is in the extended position.

9. The barrier of claim 1, wherein the first elongated recess comprises a first enlarged area sized to have the first element moved into and out of engagement with the first side wall; and wherein the second elongated recess comprises a second enlarged area sized to have the second element moved into and out of engagement with the second side wall.

10. A barrier comprising:

a front wall having a lower edge and an upper edge, the front wall extending in a substantially upward direction relative to a supporting surface, the lower edge spaced apart from supporting surface and forming a gap between the lower edge and the supporting surface;

a first side wall extending at an angle from the front wall and extending upward from the supporting surface, the first side wall having a first elongated recess formed therein extending in a substantially upward direction; and a shield movably attached to the first side wall, a first element extending from the shield and received in the first elongated recess, the first element movable within the first elongated recess and the shield movable between an extended position with the shield abutting the supporting surface and extending upward from adjacent the supporting surface to a height at least equal to a height of the gap formed between the lower edge of the front wall and the supporting surface, and a retracted position with the shield withdrawn relative to the supporting surface.

11. The barrier of claim 10, wherein the first element is located at a first position in the first elongated recess when the shield is located in the extended position, and wherein the first element is located at a second position in the first elongated recess when the shield is located in the retracted position.

12. The barrier of claim 11, wherein the first elongated recess extends from a location proximate the lower edge of the first side wall to a location relatively remote from the lower edge of the first side wall, wherein the first element is positioned at the location proximate the lower edge of the first side wall when the shield is in the extended position, and wherein the first element is positioned at the location relatively remote from the lower edge of the first side wall when the shield is in the retracted position.

13. The barrier of claim 12, wherein the shield comprises a first planar portion and a second planar portion, the second planar portion intersecting with and extending from first planar portion at an angle.

14. The barrier of claim 13, wherein the first element extends from the shield proximate a location the second planar portion intersects with the first planar portion.

15. The barrier of claim 14, wherein the first planar portion extends toward the supporting surface, the first planar portion abutting the supporting surface when the shield is in the extended position.

16. The barrier of claim 15, wherein the first planar portion extends from the first element, toward the supporting surface, and away from the front wall when the shield is in the extended position.

17. The barrier of claim 16, wherein the first planar portion extends from the first element, toward the supporting surface, and toward the front wall when the shield is in the extended position.

18. The barrier of claim 10, wherein the first elongated recess comprises a first enlarged area sized to have the first element moved into and out of engagement with the first side wall.

* * * * *